US007588388B2

(12) United States Patent
Hall et al.

(10) Patent No.: US 7,588,388 B2
(45) Date of Patent: Sep. 15, 2009

(54) PAVED SURFACE RECONDITIONING SYSTEM

(76) Inventors: David R. Hall, 2185 S. Larsen Pkwy., Provo, UT (US) 84606; David Wahiquist, 2185 S. Larsen Pkwy., Provo, UT (US) 84606; Timothy C. Duke, 2185 S. Larsen Pkwy., Provo, UT (US) 84606; Codrin Daranga, 2185 S. Larsen Pkwy., Provo, UT (US) 84606

( * ) Notice: Subject to any disclaimer, the term of this patent is extended or adjusted under 35 U.S.C. 154(b) by 611 days.

(21) Appl. No.: 11/470,570

(22) Filed: Sep. 6, 2006

(65) Prior Publication Data

US 2008/0056820 A1 Mar. 6, 2008

(51) Int. Cl.
*E01C 19/22* (2006.01)
*E01C 19/48* (2006.01)

(52) U.S. Cl. ..... 404/111; 404/101; 404/102; 404/107; 404/108; 404/113; 404/114; 404/118

(58) Field of Classification Search ..... 404/101–119
See application file for complete search history.

(56) References Cited

U.S. PATENT DOCUMENTS

| | | | |
|---|---|---|---|
| 1,887,341 | A | 11/1932 | Venable |
| 1,898,158 | A | 2/1933 | Winkle |
| 2,039,078 | A | 4/1936 | Hertwig |
| 2,098,895 | A | 11/1937 | Velten |
| 2,633,782 | A | 4/1953 | Clement |
| 2,893,299 | A | 7/1959 | Moir |
| 2,908,206 | A | 10/1959 | Melanson |
| 2,938,438 | A | 5/1960 | Hamilton |
| 3,075,436 | A | 1/1963 | McRae |
| 3,361,042 | A | 1/1968 | Cutler |
| 3,732,023 | A | 5/1973 | Rank |
| 3,817,644 | A | 6/1974 | Matson |
| 3,970,404 | A | 7/1976 | Benedetti |
| 3,989,401 | A | 11/1976 | Moench |
| 4,018,540 | A | 4/1977 | Jackson |
| 4,104,736 | A | 8/1978 | Mendenhall |
| 4,124,325 | A | 11/1978 | Cutler |
| 4,127,351 | A | 11/1978 | Vural |
| 4,172,679 | A | 10/1979 | Wirtgen |
| 4,195,946 | A | 4/1980 | Swisher |
| 4,215,949 | A | 8/1980 | Gabriel |
| 4,261,669 | A | 4/1981 | Edo |
| 4,313,690 | A | 2/1982 | Hojbjerg |
| 4,335,975 | A | 6/1982 | Schoelkopf |
| 4,347,016 | A | 8/1982 | Sindelar et al. |
| 4,407,605 | A | 10/1983 | Wirtgen |
| 4,473,320 | A | 9/1984 | Register |
| 4,534,674 | A | 8/1985 | Cutler |
| 4,594,022 | A | 6/1986 | Jeppson |
| 4,668,017 | A | 5/1987 | Peterson |

(Continued)

*Primary Examiner*—Raymond W Addie
(74) *Attorney, Agent, or Firm*—Tyson J. Wilde

(57) ABSTRACT

In one aspect of the present invention, a paved surface reconditioning system has a vehicle adapted to traverse a paved surface. The vehicle having a press plate with a working surface having plurality of nozzles disposed therein. At least one of the nozzles has an inner diameter less than 1 mm. A fluid passage may connect the nozzle to a reservoir. The reservoir and fluid passage have a volume and a pressurizing mechanism in communication with the volume and being adapted to pressurize at least a portion of the volume.

14 Claims, 21 Drawing Sheets

U.S. PATENT DOCUMENTS

| | | | |
|---|---|---|---|
| 4,676,689 | A | 6/1987 | Yant |
| 4,692,350 | A | 9/1987 | Clarke |
| 4,784,518 | A | 11/1988 | Cutler |
| 4,793,730 | A | 12/1988 | Butch |
| 4,968,101 | A | 11/1990 | Bossow |
| 5,026,205 | A | 6/1991 | Gorski |
| 5,131,788 | A | 7/1992 | Hulicsko |
| 5,366,320 | A | 11/1994 | Hanlon |
| 5,556,225 | A | 9/1996 | Marino |
| 5,765,926 | A | 6/1998 | Knapp |
| 5,791,814 | A | 8/1998 | Wiley |
| 5,947,636 | A | 9/1999 | Mara |
| 5,947,638 | A | 9/1999 | Heims |
| 5,951,561 | A | 9/1999 | Pepper |
| 6,122,601 | A | 9/2000 | Swanson |
| 6,158,920 | A | 12/2000 | Malot |
| 6,287,048 | B1 | 9/2001 | Hollon |
| 6,371,689 | B1 | 4/2002 | Wiley |
| 6,551,018 | B2 | 4/2003 | Baker |
| 6,577,141 | B2 | 6/2003 | Gandrud |
| 6,623,207 | B2 | 9/2003 | Grubba |
| 6,769,836 | B2 | 8/2004 | Lloyd |
| 6,799,922 | B2 | 10/2004 | Smith |
| 6,846,354 | B2 | 1/2005 | Larsen |

PAVED SURFACE RECONDITIONING SYSTEM

BACKGROUND OF THE INVENTION

Modern road surfaces typically comprise a combination of aggregate materials and binding agents processed and applied to form a smooth paved surface. The type and quality of the pavement components used, and the manner in which the pavement components are implemented or combined, may affect the durability of the paved surface. Even where a paved surface is quite durable, however, temperature fluctuations, weather, and vehicular traffic over a paved surface may result in cracks and other surface or sub-surface irregularities over time. Road salts and other corrosive chemicals applied to the paved surface, as well as accumulation of water in surface cracks, may accelerate pavement deterioration.

Road resurfacing equipment may be used to mill, remove, and/or recondition deteriorated pavement. In come cases, heat generating equipment may be used to soften the pavement, followed by equipment to mill the surface, apply pavement materials, and plane the surface. Often, new pavement materials may be combined with materials milled from an existing surface in order to recondition or recycle existing pavement. Once the new materials are added, the materials may be compacted and planed to restore a smooth paved surface.

U.S. Pat. No. 4,793,730 which is herein incorporated by reference for all that it contains, discloses a method and apparatus for renewing the surface of asphaltic paving at low cost and for immediate reuse. The asphalt surface is heated to about 300.degree.-500.degree. F. The surface is broken to a depth of about two inches and the lower material thoroughly mixed in situ with the broken surface material. After mixing, the material is further heated to fuse the heated mixture into a homogeneous surface. The surface is screeded for leveling and compacted by a road roller. A road machine is disclosed having a steam manifold for heating the asphalt, transversely reciprocating breaker bars having teeth adjusted to the depth desired, toothed mixing cylinders for mixing the broken material, and a second steam manifold for reheating the mixed material. Reciprocating screed bars on the road machine level the mixed and heated material. Final compacting may be done with a conventional road roller.

U.S. Pat. No. 4,261,669 which is herein incorporated by reference for all that it discloses, teaches a method and apparatus for repairing asphalt concrete road surfaces wherein a tractor a steam box and a car mounted with a screw cutter are coupled in this order and a series of linearly operated equipment is used on the asphalt concrete paved road surface, including a heater car, an asphalt finisher and a road roller in this order after the car. Each of the equipment is made to advance at low speed and the asphalt concrete paved road surface is artificially heated by the steam box to impart fluidity to the road surface, after which it is cut with the screw cutter and the cut asphalt concrete is conveyed into a heating chamber of the heater car, and water content in the asphalt concrete is removed by heating and stirring. The resulting asphalt concrete is adjusted to an optimum temperature suitable for asphalt concrete paving, and then is discharged from the heating chamber, and charged onto the surface of the cut road directly and thereafter the asphalt concrete paved road surface is treated by using the asphalt finisher and the road roller.

U.S. Pat. No. 5,486,554 which is herein incorporated by reference for all that it contains, discloses that a low cost method for preparing foamed or aerated asphalt-rubber paving compositions is provided wherein a flowable mixture including respective quantities of asphalt and finally divided reclaimed rubber particles is first directed into a rocket-type reactor along with steam and/or water, thereby subjecting the mixture to conditions of elevated temperature, pressure and shear. Thereafter, the initially reacted mixture is passed into a pressurized, secondary reaction vessel system in order to complete the gelation reaction in a period of, e.g., 7-15 minutes. The preferred apparatus includes; a rocket-type primary reactor presenting a confined reaction zone; asphalt-rubber and water/steam conduits communicate with the zone. The output of the primary reactor feeds directly into a pressurized tank forming a part of the downstream secondary reaction and recovery system, where the gelation reaction is completed. The preferred system includes a total of five serially interconnected tanks housed within an insulative shell and heated by means of burner.

U.S. Pat. No. 4,592,507 which is herein incorporated by reference for all that it contains, discloses an apparatus and a method for coating a road surface with bitumen binder material. The apparatus includes distribution conduit members for conducting bitumen material in a fluid state from a continuous source thereof and distribution conduit members for conducting gas, preferably steam, from a continuous source thereof. Pluralities of mixer housings are joined to the conduit members and receive bitumen binder material and gas. The apparatus is carried by a vehicle which travels over a road surface. The bitumen binder material and the gas are mixed and sprayed upon the road surface as the vehicle travels over the road surface U.S. Pat. No. 5,324,136 which is herein incorporated by reference for all that it contains, discloses an apparatus for spreading a fluid or similar substance, especially a bonding emulsion for road asphalt onto the surface of a road, comprising, on a movable vehicle, at least one spreading boom, along which the spreading is carried out at least partially, said boom being associated with at least one ejection nozzle and with a feed circuit and being capable of being displaced relative to the movable vehicle transversely to the direction of movement of the latter, and is associated with motor means intended for driving it in displacement, during spreading, in a to-and-fro movement. The machine of the finisher type comprises such an apparatus.

U.S. Pat. No. 5,279,500 which is herein incorporated by reference for all that it contains, discloses an apparatus for spreading a fluid or like substance, for example, an emulsion for bonding bituminous coated material on the surface of a road including a mobile machine, at least one spreading bar along which the spreading is at least partially effected, and at least one ejection nozzle associated with the at least one spreading bar. A supply circuit may supply emulsion to the nozzle. The at least one nozzle is associated with a mechanism for controlling delivery of the emulsion and a mechanism for controlling positioning of the nozzle relative to the machine. Both of the mechanisms are operated simultaneously, in dependence on the movement of the mobile machine, in such a manner that the nozzle effects spraying by sequenced jets of the substance to continuously cover the surface which is to be spread. The machine provided with this apparatus is of the finisher type

BRIEF SUMMARY OF THE INVENTION

In one aspect of the present invention, a paved surface reconditioning system has a vehicle adapted to traverse a paved surface. The vehicle having a press plate with a working surface having plurality of nozzles disposed therein. At least one of the nozzles has an inner diameter less than 1 mm. A fluid passage may connect the nozzle to a reservoir. The reservoir and fluid passage have a volume and a pressurizing mechanism in communication with the volume and being adapted to pressurize at least a portion of the volume.

The vehicle may have a compaction element selected from the group consisting of rollers, tampers, plates, vibrators and combinations thereof. The pressurizing mechanism may compress the fluid to a pressure of 3000 psi to 65000 psi. The fluid may be heated to a temperature of 250° F. to 700° F. The fluid may include bitumen, tar, oil, water, resins, binding agents, waxes, synthetic clay, maltenes, asphaltenes, surfactants, sand, grit, or combinations thereof.

The working surface of the press plate may have a coating comprising a material selected from the group consisting of Fluoropolymers, Teflon®, diamond, carbide, carbon coatings, cubic boron nitride, ceramics, chromium, or combinations thereof. The press plate may also have a heating element and a sensor selected from the group consisting of temperature sensors, pressure sensors, position sensors, density sensors, compressive strength sensor, porosity sensor, pH sensor, electric resistively sensor, inclination sensor, nuclear sensor, acoustic sensor, velocity sensor, moisture sensor, capacitance sensor, and combinations thereof.

The press plate may further have a sealing element on at least one side adapted to engage the paved surface. In certain embodiments the press plate may be part of a closed loop system. In one embodiment the press plate may be adapted to comply with the paved surface. The working surface may have a portion adapted to contact the paved surface and an expansion cavity formed in the portion with or without an aggregate dispenser, a nozzle and a release vent with passages to the fluid reservoir. The passage from the release vent to the fluid reservoir may have a condenser.

In another aspect of the present invention, a method of reconditioning a paved surface may include the steps of applying a first pressure to an area of a paved surface through a pressure transferring medium, the pressure transferring medium may have at least one aperture with a nozzle; pressurizing a volume of the paved surface adjacent the area to a second pressure by injecting a pressurized fluid into the volume while maintaining a pressure to the area of the paved surface; and controllably releasing the pressure to the area. In the embodiment of the current method the motorized vehicle may have a compaction element selected from the group consisting of rollers, tampers, plates, vibrators and combinations thereof. In one embodiment the injected paved surface may be compacted with the pressure transferring medium.

DETAILED DESCRIPTION OF THE INVENTION AND THE PREFERRED EMBODIMENT

In this application, "pavement" or "paved surface" refers to any artificial, wear-resistant surface that facilitates vehicular, pedestrian, or other form of traffic. Pavement may include composites containing oil, tar, tarmac, macadam, tarmacadam, asphalt, asphaltum, pitch, bitumen, minerals, rocks, pebbles, gravel, polymeric materials, sand, polyester fibers, Portland cement, petrochemical binders, or combinations thereof. Likewise, rejuvenation materials refer to any of various binders, oils, and resins, including bitumen, surfactant, polymeric materials, emulsions, asphalt, tar, cement, oil, pitch, or combinations thereof. Reference to aggregates refers to rock, crushed rock, gravel, sand, slag, soil, cinders, minerals, or other course materials, and may include both new aggregates and aggregates reclaimed from an existing roadway. Likewise, the term "degrade" or "degradation" is used in this application to mean milling, grinding, cutting, ripping apart, tearing apart, exploding apart, forcing apart, or otherwise taking or pulling apart a pavement material into smaller constituent pieces.

Figure 1:
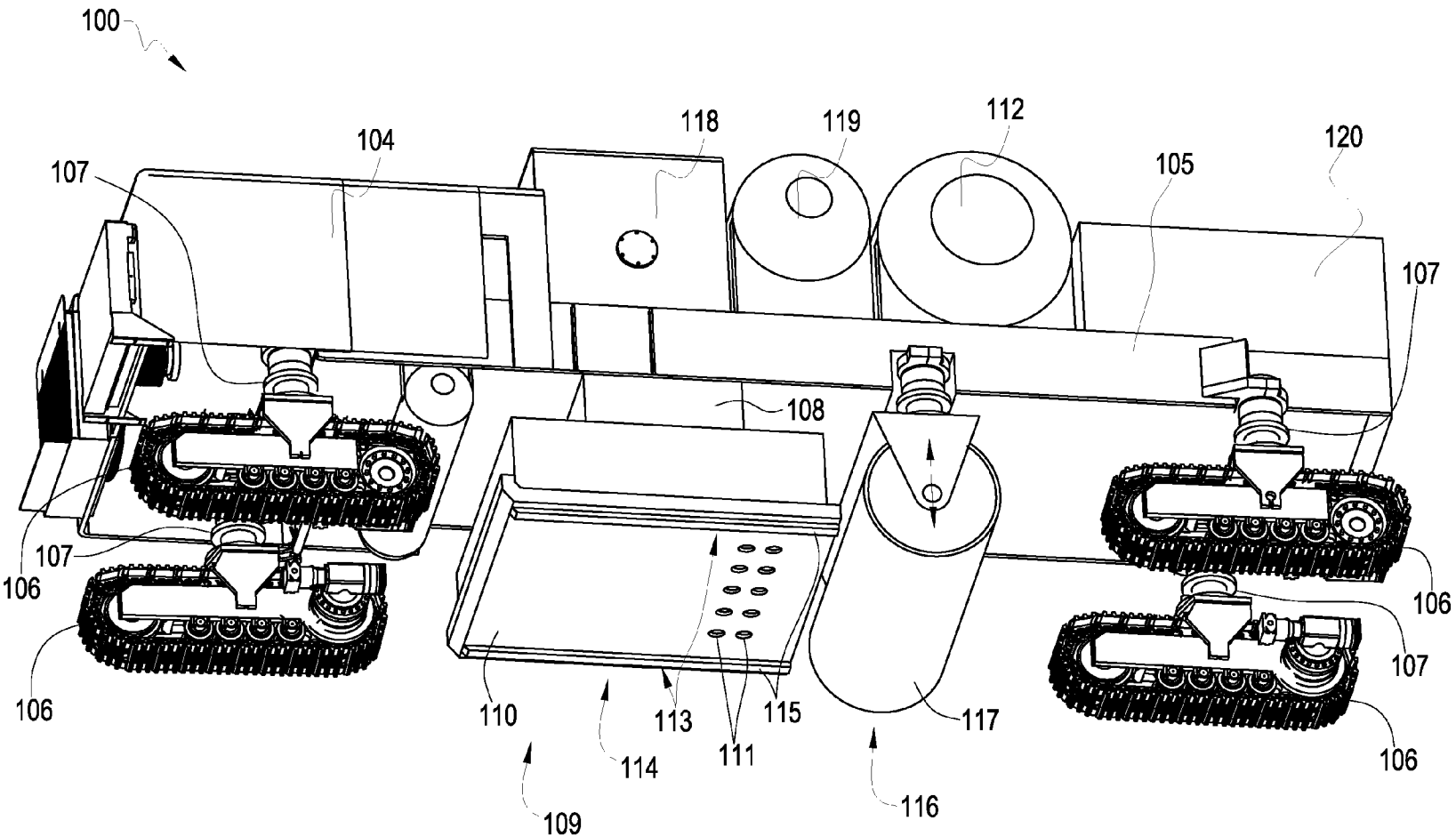
FIG. 1 is a perspective diagram of an embodiment of a motorized vehicle for on site paved surface reconditioning

Referring to FIG. 1, in selected embodiments, a motorized vehicle 100 may include a shroud 104, covering various internal components of the motorized vehicle 100, a frame 105, and a translational element 106 such as tracks, wheels, or the like, to translate or move the vehicle 100, such translational element being well known to those skilled in the art. The motorized vehicle 100 may also include means 107 for adjusting the elevation and slope of the frame 105 relative to the translational element 106 to adjust for varying elevations, slopes, and contours of the underlying road surface.

In one embodiment the vehicle may comprise a actuator 108 intermediate the vehicle 100 and a press plate 109. The press plate 109 may have a working surface 110 with at least one nozzle 111 disposed therein. At least a portion of the working surface 110 may be adapted to contact a paved surface. In the current embodiment multiple nozzles 111 are disposed on the working surface 110 of the press plate 109.

The nozzles 110 may be in communication with a fluid reservoir 112 that may store rejuvenation materials such as bitumen, tar, oil, water, resins, binding agents, waxes, synthetic clay, maltenes, asphaltenes, surfactants, sand, grit, and combinations thereof. The fluid reservoir 112 may also heat and pressurize the stored rejuvenation materials. To maintain pressure under the press plate 109 and prevent leakage of rejuvenation material the press plate 109 may have a sealing element 113 on at least one side 114 adapted to engage the paved surface. In the present embodiment the press plate 109 has two sealing elements 113 on its sides 114 comprising carbide strips 115 along the length of the press plate 109.

The nozzle may comprise be made of a steel, stainless steel, or a hardened steel. Preferably, the nozzle is made out of a material comprising a hardness greater than 58 HRc, such as tungsten carbide or diamond. Suitable materials for the nozzle include diamond, natural diamond, polycrystalline diamond, cubic boron nitride, vapor-deposited diamond, diamond grit, polycrystalline diamond grit, cubic boron nitride grit, chromium, tungsten, titanium, molybdenum, niobium, a cemented metal carbide, tungsten carbide, aluminum oxide, zircon, silicon carbide, whisker reinforced ceramics, diamond impregnated carbide, diamond impregnated matrix, silicon bonded diamond, or combinations thereof. The inner diameter of the nozzle is preferably less than 1 mm. In some embodiment, the inner diameter is between 1 to 1,000 microns. Preferably the inner diameter is 0.001 to 0.008 inches. In some embodiments, the a nozzle density on the press plate is 1 nozzle per square inch. In other embodiments, the nozzle density may be 1-7 nozzles per square inch.

The nozzles 110 are adapted to inject the rejuvenation material into the paved surface while the press plate 109 compresses against the paved surface. The nozzles 110 should inject the fluid into the paved surface at such a temperature and/or pressure that the binder bonding the aggregate in the paved surface melt and/or erode allowing the rejuvenation material to rebind the aggregate together. In some embodiments, the press plate 109 will provide enough pressure to the paved surface that the area of lowest pressure for the rejuvenation material to flow into will be within the pavement. The press plate 109 may provide pressure long enough that the rejuvenation material diffuses in-between all of the aggregate. Preferably, the injection pressure is not sufficient to erode or damage the individual pieces of aggregate. Preferably, there are sensors mounted on the vehicle 100 which sense the subsurface condition of the paved surface, including the extent and depth of damage to the paved surface. In areas where the damage is comparatively deep, the press plate 109 may provide pressure longer to allow the rejuvenation material to migrate deeper into the paved surface.

The motorized vehicle 100 may also comprise a compaction element/elements 116 selected from the group consisting of rollers, tampers, plates, vibrators and combinations thereof. The working surface 110 of the press plate 109 may press against the paved surface while the nozzles 111 inject rejuvenation material into the paved surface. The surface may soften and the aggregates may loosen because of the temperature and pressure of the injected material. During this process the aggregates within the paved surface may also be recoated with rejuvenation material. In the present embodiment the compaction element 116 is a roller 117. The roller 117 may be placed after the press plate 109 so that the loosened and/or softened mix may be recompacted to a desired density. The vehicle 100 may also include a tank 118 for storing hydraulic fluid, a fuel tank 119 and a hopper 120 for storing aggregate such as gravel, rock, sand, pebbles, macadam, concrete, or the like.

Figure 2:
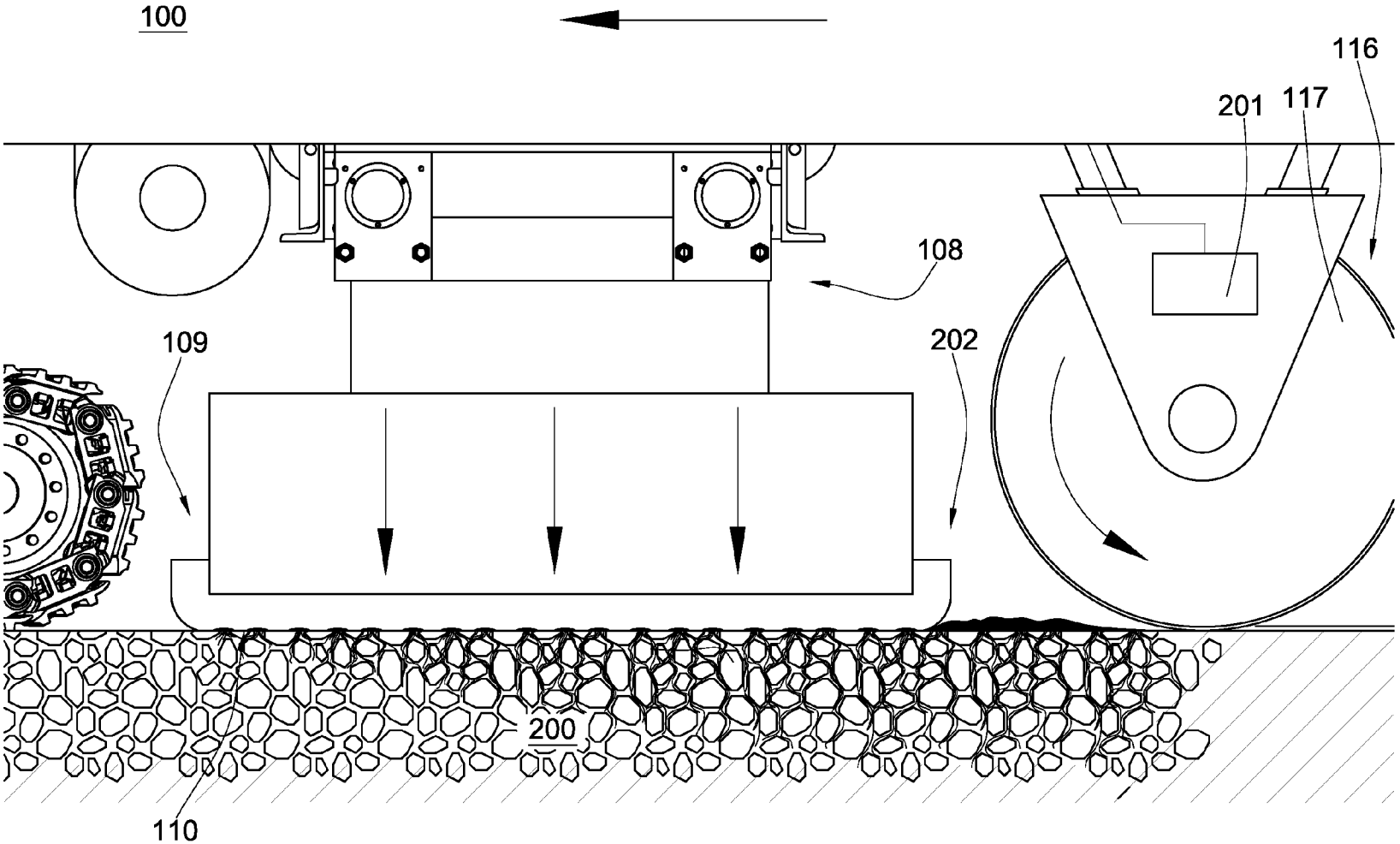
FIG. 2 is a side diagram of an embodiment of a mobile vehicle for reconditioning a paved surface.

FIG. 2 is a diagram of a side view of an embodiment of a mobile vehicle 100 for reconditioning a paved surface 200. The actuator 108 may comprise hydraulic actuators, motors, pumps, solenoids, piezoelectric devices, magnetostrictive devices, electric actuators, smart material actuators, and combinations thereof capable of raising and lowering the press plate 109. The press plate 109 may be lowered so that the working surface 110 is in contact with the paved surface 200. The actuator 108 may be controlled such that varying amounts of pressure may be applied to the paved surface 200 by the press plate 109. In one embodiment the press plate 109 may apply enough pressure to the paved surface 200 to prevent the paved surface 200 from expanding upwards when injected with the pressurized fluid. The applied pressure may also be sufficient to prevent the press plate 109 from disengaging the paved surface 200.

As the vehicle 100 moves along the paved surface, the paved surface 200 under the press plate 109 may become pressurized. Once the press plate moves off of a pressurized portion of pavement 200, the pavement 200 may release the pressure by expanding. After expansion the pavement 200 may be recompacted using a compaction element 116. In the present embodiment the compaction element 116 is a roller 117. The roller 117 may comprise a sensor 201 such as a density sensor so that the density of the pavement 200 may be measured and the pressure applied by the compaction element 116 adjusted until a desired density is achieved.

Figure 3:
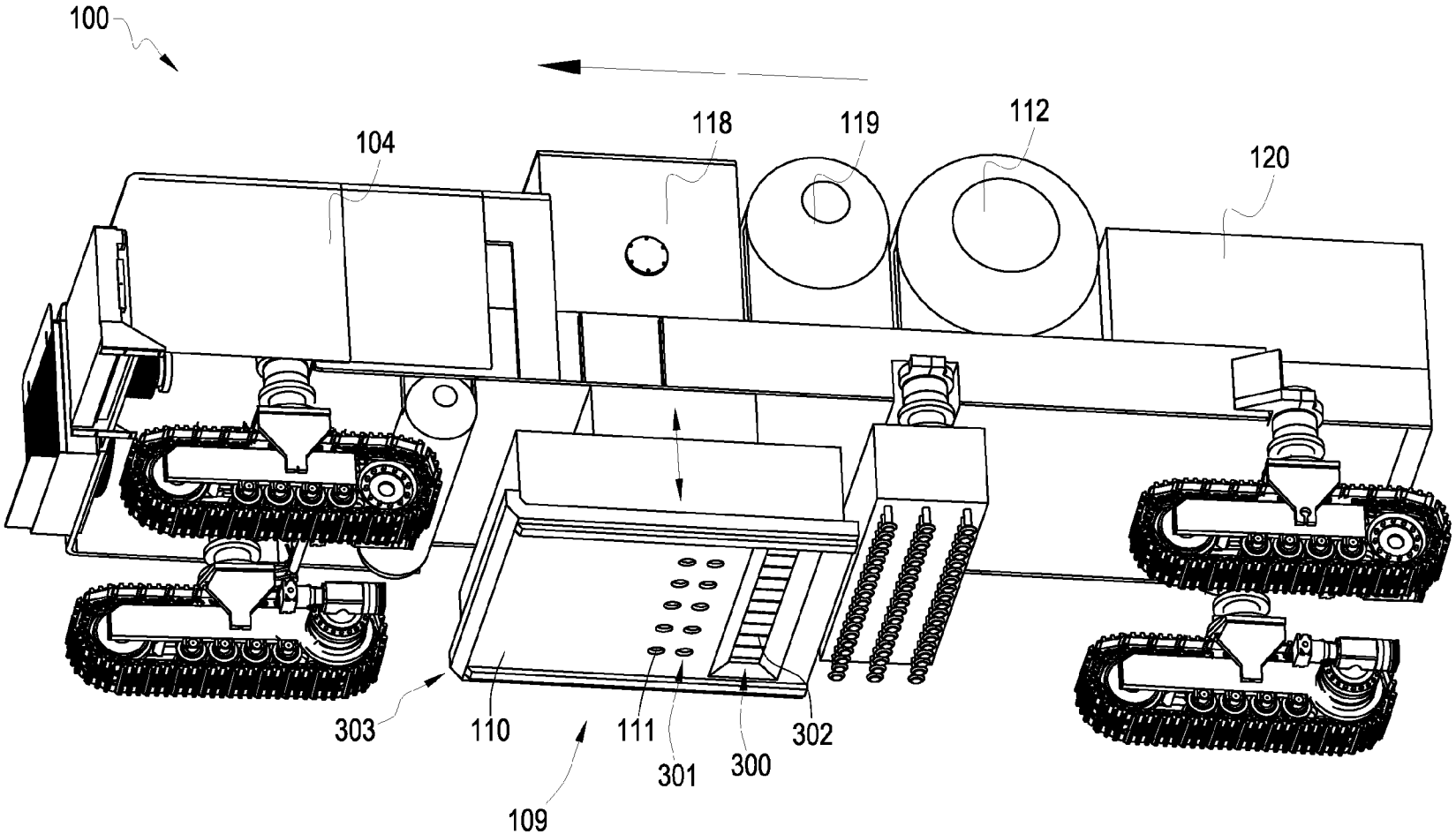
FIG. 3 is a perspective diagram of an embodiment of a motorized vehicle for on site paved surface reconditioning.

FIG. 3 is a perspective diagram of an embodiment of a motorized vehicle 100 for on site reconditioning of a paved surface. The press plate 109 of the current embodiment may comprise an expansion chamber 300 on the working surface 110 after one or more rows 301 of nozzles 111. As the expansion chamber moves over the areas of the paved surface which were formerly held in by the press plate, the aggregate will explode into the expansion chamber due to an unequal distribution of pressure. In some embodiments during the explosion, oil based rejuvenation material which were injected into the paved surface may coat all of the surfaces of each aggregate. In other embodiments, oil based rejuvenation materials may be sprayer, misted or otherwise added into the paved surface mix while it is expanded in the expansion chamber. Preferably, the press plate moves fast enough so that the explosion occurs before the heat from the hot rejuvenated material is absorbed into the aggregate. This process may only require that the surface of the aggregate be exposed to the heat. The expansion chamber 300 may comprise vents 302 to release the moisture from the pavement or from the rejuvenation material. It is believed that in this process, that the aggregate may not be required to be heated. The aggregate in some roads may be roughly 94 percent or more of the road. In some embodiments, the system of the present invention may only need to heat six percent of the road, realizing significant energy and environmental saving compared to typical road resurfacing methods.

The press plate 109 may also comprise a beveled or curved front edge 303. This may allow the press plate 109 to ride smoother upon uneven or sloped surfaces. The expansion chamber 300 may be a U-shaped trough, trapezoidal, rectangular, triangular, curved, or combinations thereof. In one embodiment the expansion chamber 300 may be formed in the working surface 110 of the press plate 109 such that it releases at least a portion of the pressure in the paved surface.

Figure 4:
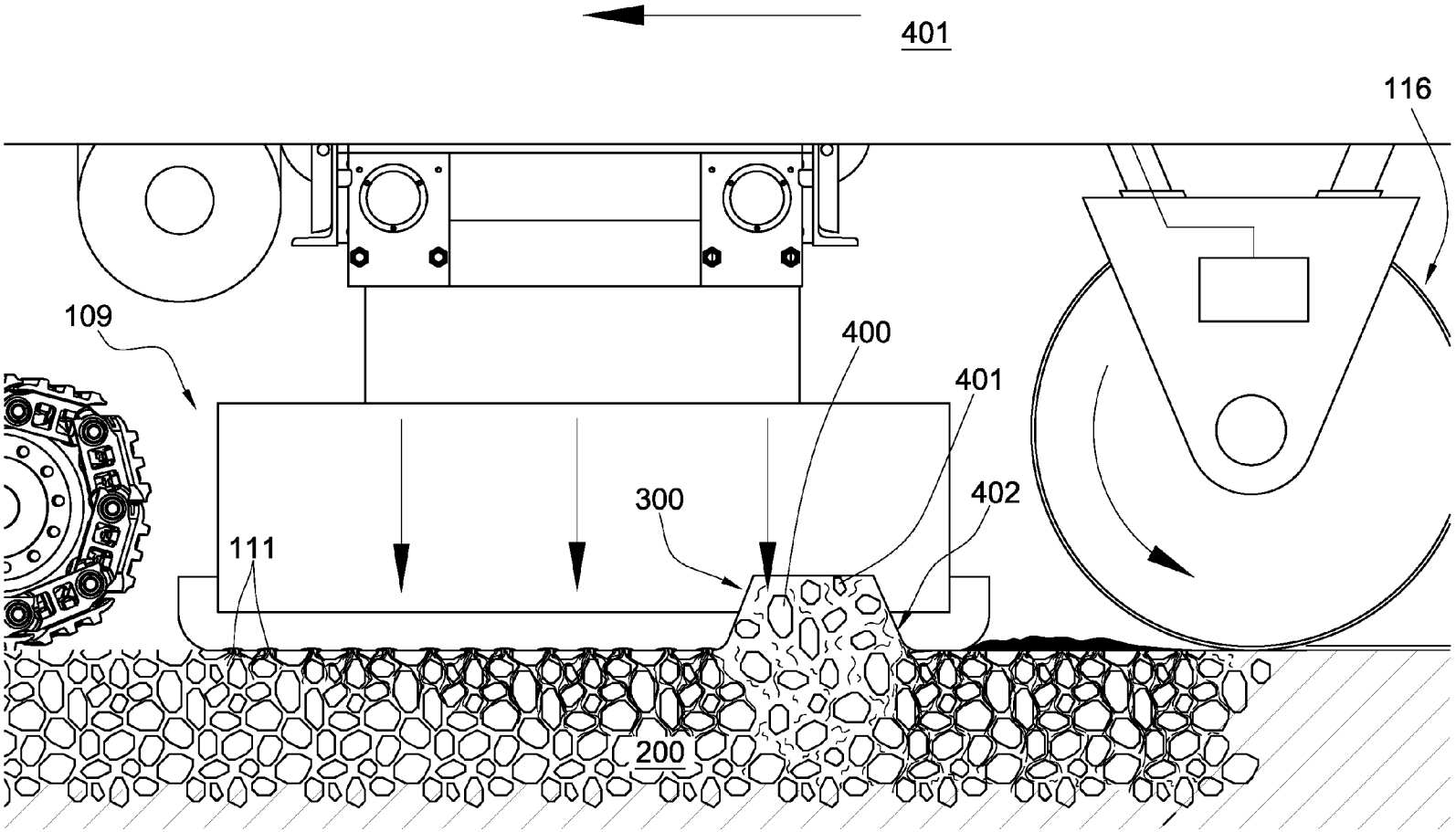
FIG. 4 is a side diagram of an embodiment of a portion of a motorized vehicle for reconditioning a paved surface.

FIG. 4 is a side diagram of an embodiment of a portion of a motorized vehicle 100 for reconditioning a paved surface 200. In the current embodiment the nozzles 111 may inject rejuvenation fluid at a constant temperature and pressure into the paved surface 200. Other embodiments may include pulsing rejuvenation fluid into the paved surface 200 at varying frequencies and patterns. As the vehicle 100 moves along the paved surface 200 the pressure and temperature may continue to increase within the paved surface 200 until reaching the expansion chamber 300. As the expansion chamber 300 moves over a portion of pressurized pavement 200, the pavement 200 may explode within the chamber 500 separating the aggregate of the paved surface 200 from each other. By separating the aggregate, the binder coating each aggregate may be exposed to the heat and at least partially melt. In some embodiments, the separating of the aggregate will also allow the binder coating each aggregate to be exposed to the rejuvenation material that was injected into the pavement 200 or rejuvenation material that is added in the expansion chamber 300. The paved surface 200 may explode such that some of the aggregate come off in clumps, but preferably each aggregate is separated from each other. This may be controlled by the pressure and the temperature with which the fluid is injected. After the explosion of the pavement 200 the back edge 402 of the expansion chamber 300 may act as a screed and smooth out and/or compact the loosened material 400, 401. A compaction element 116 may be placed close behind the press plate 109 to compact the chunks 400 and constituent pieces 401 to a desired density.

Figure 5:
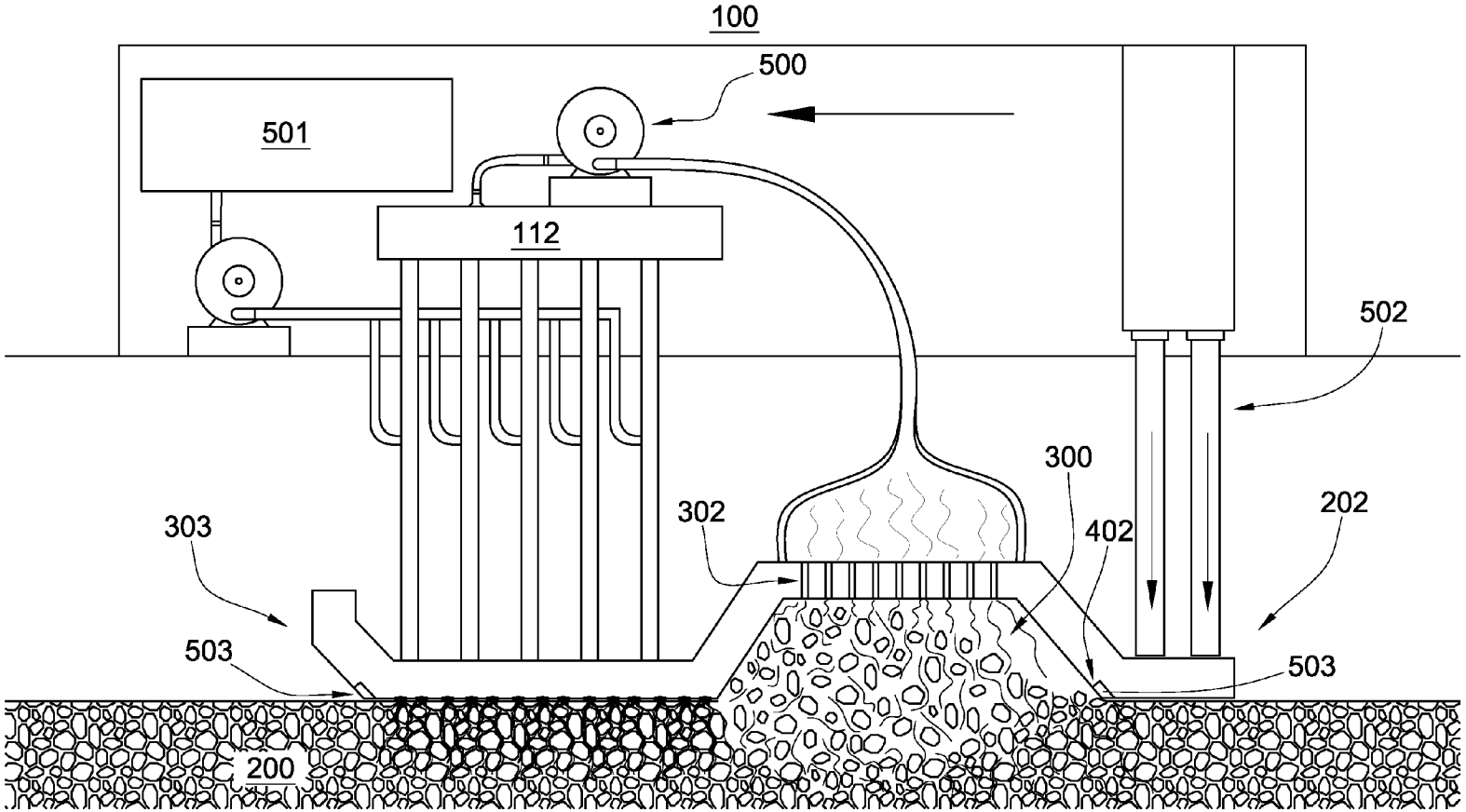
FIG. 5 is a cross sectional side diagram of an embodiment of a motorized vehicle for reconditioning a paved surface.

FIG. 5 is a cross sectional diagram of an embodiment of a motorized vehicle 100 for reconditioning a paved surface 200. The expansion chamber 300 may comprise a vent 302 to release excess moisture (or steam 650—see FIG. 6) from the paved surface 200. The moisture may have been injected as at least a portion of the rejuvenation material, or the moisture may be residual moisture that was already present in the paved surface 200 before the conditioning process started. The moisture may be steam and it may collected and be condensed back to a liquid by a condenser 500. In one embodiment the condensed liquid may be passed back into the reservoir 112 with the other rejuvenation fluid. Alterations of this embodiment may include passing the condensed liquid into a water reservoir 112 for holding. The majority of the fluid may be water which may be pressurized and heated in the water reservoir 112. A separate reservoir 501 may be used to store and pressurize oil and other rejuvenation materials to be injected into the pavement 200. Water may be mixed with a binder such as bitumen under pressure before they are injected into the paved surface 200. Preferably the temperature is adjusted such that the water will be evaporated in the expansion chamber 300 while the bitumen and/or other components of the rejuvenation material will not evaporate but will remain in the paved surface 200.

In selected embodiments an actuator 502 may apply a desired force to the back end 202 of the press plate 109, such that the back end 202 of the plate 109 compacts the loosed aggregate back into a reconditioned paved surface. The actuator 502 may be a hydraulic cylinder, electric actuator or any other form of actuator known in the art. The back edge 402 of the expansion chamber may comprise a hardened insert 503 such as a tungsten carbide insert, or a polycrystalline diamond insert. The insert 503 may help prolong the life of the back edge 402 of the expansion chamber 300 when used to level out the loosened pavement 200. The beveled or curved front end of the press plate 109 may also comprise a hardened insert 503 to prolong its life. Preferably, the hardened insert 503 comprises a hardness of at least 58 HRc. Other possible materials may include hardened steel, hard facing, cubic boron nitride, and other ceramics and/or composites.

Figure 6:
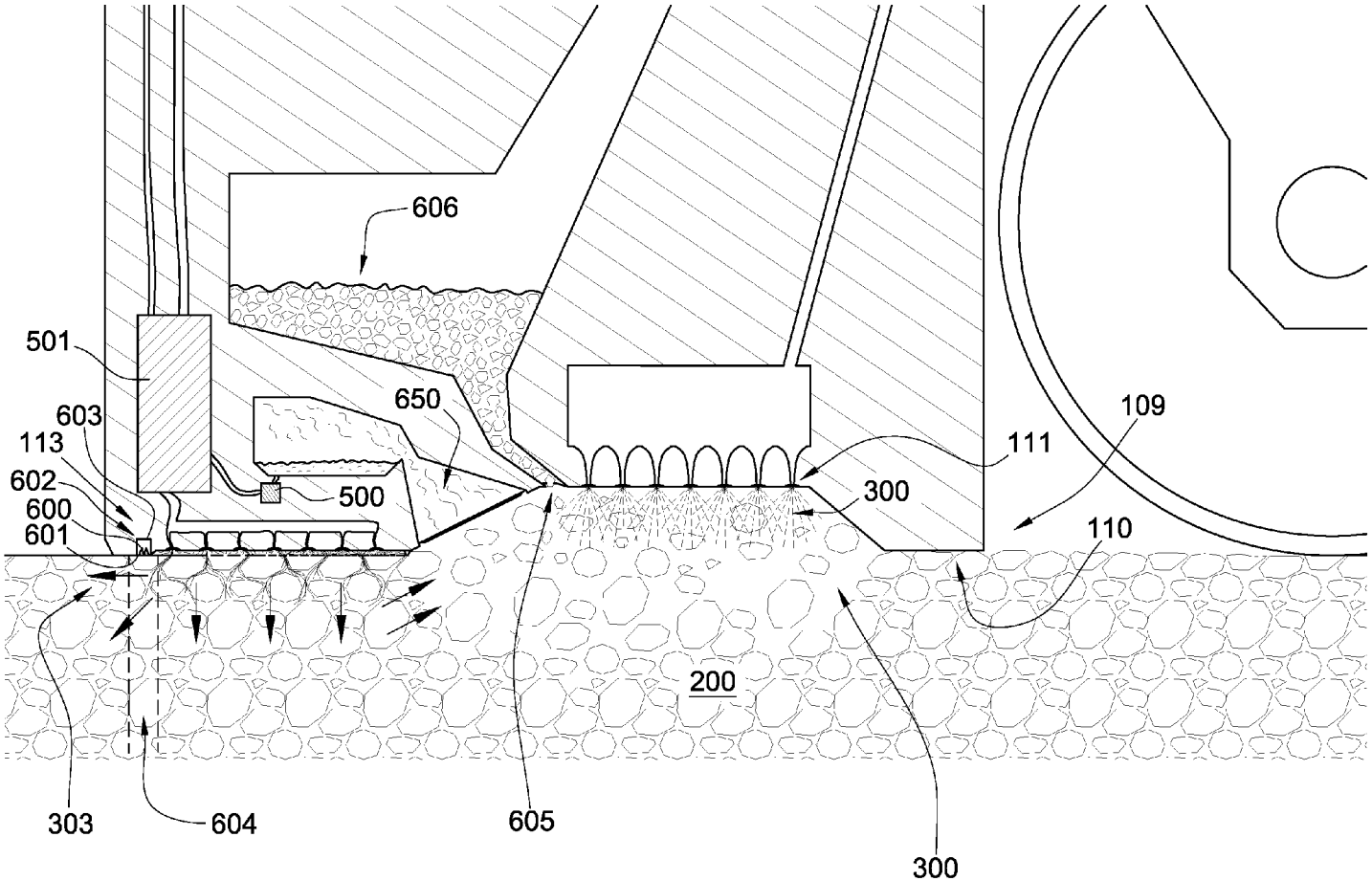
FIG. 6 is a cross sectional diagram of an embodiment of a motorized vehicle adapted to recondition a paved surface.

FIG. 6 is a cross sectional diagram of an embodiment of a motorized vehicle 100 adapted to recondition a paved surface 200. The front edge 303 of the press plate 109 may comprise a seal 113 to prevent the injected fluid from leaking between the paved surface 200 and the pressure plate 109. The seal 113 may be formed by machining a series of groves 600 and ridges 601 on the working surface 110 of the plate 109. Alternately, an insert 602 with groves 600 and ridges 601 may be brazed into a recess 603 in the working surface 110 of the press plate 109. Variations of the present embodiment may include placing an insert 602 of carbide or other hard material into a recess 603 on the front end of the press plate 109. The hard insert 602 may extend beyond the working surface 110 of the press plate 109. With the insert 602 extending beyond the working surface 110 the amount of force to the region 604 of pavement 200 underneath the hard insert 602 may exceed that of the pavement 200 underneath the rest of the plate 109. This may help prevent the leaking of rejuvenation fluids being injected.

The expansion chamber 300 may comprise an aggregate dispenser 605. The aggregate dispenser 605 may dispense aggregate 606 at a desired rate or be control by a feedback network (not shown) that is capable of determining the proper ratio within the pavement 200 and add aggregate 606 accordingly. The expansion chamber 300 may also comprise at least one nozzle 110 for dispensing oil and other rejuvenation fluids. The nozzle 110 for rejuvenation fluids may be able to coat portions of the aggregate 606 that may have been missed by the injected rejuvenation material The rejuvenation fluids dispensed in the expansion chamber 300 may be sprayed or misted at a constant rate or be sprayed according to feedback from sensors (not shown).

Figure 7:
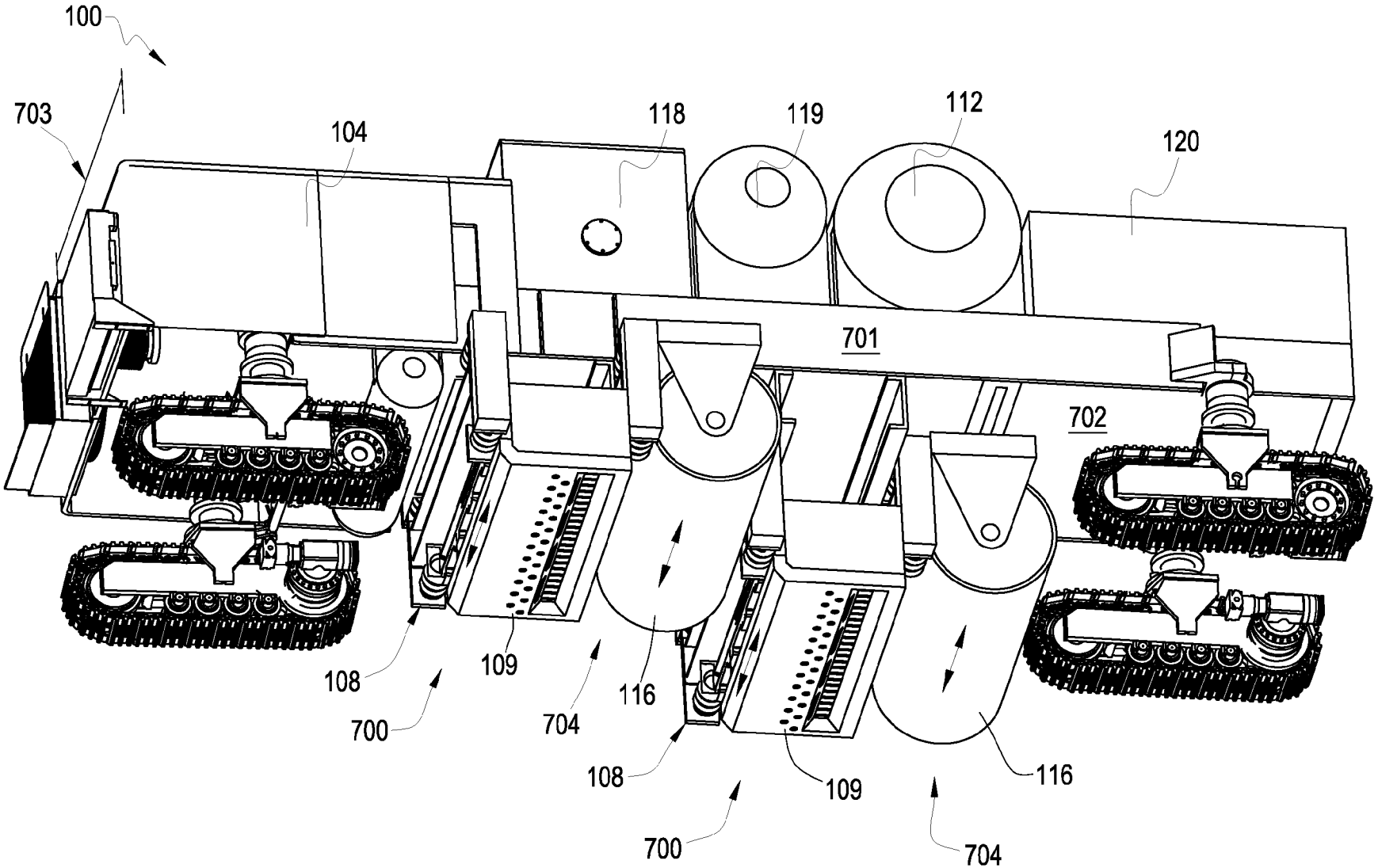
FIG. 7 is a perspective diagram of an embodiment of a motorized vehicle adapted to recondition a paved surface.

FIG. 7 is a perspective diagram of an embodiment of a motorized vehicle 100 adapted to recondition a paved surface 200. In the current embodiment, to facilitate reconditioning of a swath of pavement wider than the motorized vehicle 100, the vehicle 100 may include one or more slidable carriages 700 supported by a bearing surface 701 of an underside 702 of the motorized vehicle 100 capable of extending beyond the outer edge of the vehicle 100. In some embodiments, the carriages 700 may be as wide as the vehicle 100 itself, the carriages 700 may sweep over a width approximately twice the vehicle width 703. The carriages 700 may comprise an actuator 108 in mechanical communication with a press plate 109. The carriages 700 may allow for movement of the press plate 109 both parallel and perpendicular to the length of the motorized vehicle 100 or combinations thereof. The actuator 108 may allow for the press plate 109 to be moved vertically with respect to the paved surface 200. The slidable carriages 700 may further comprise a row 704 of compacting elements 116. Under the shroud 104, the motorized vehicle 100 may include an engine and hydraulic pumps for powering the actuator 108, the carriages 700, condensers, pressuring mechanisms or other components. The vehicle 100 may also include a reservoir 112 for storing and pressurizing the rejuvenating fluids.

Figure 8:
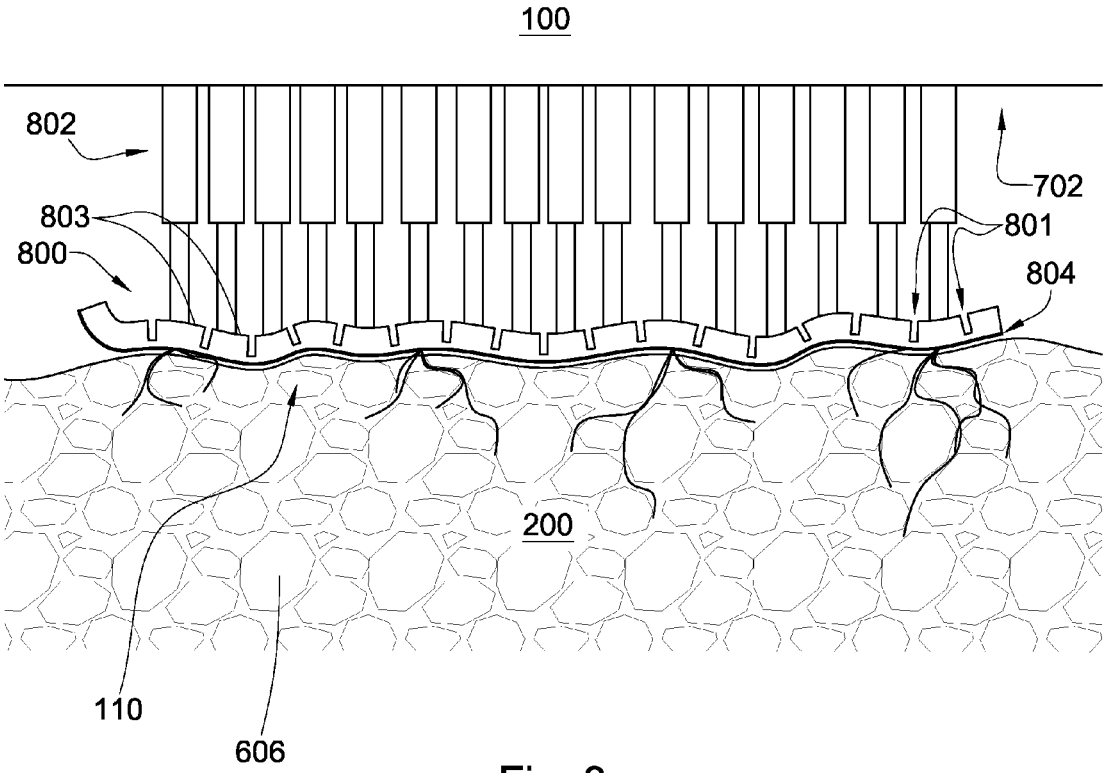
FIG. 8 is a cross sectional diagram of an embodiment of a press plate.

FIG. 8 is a cross sectional diagram of an embodiment of the press plate 109. In the current embodiment the press plate 109 is adapted to comply with the paved surface 200. Many paved surfaces 200 may not be completely flat. The upper surface 800 of the press plate 109 facing the underside 702 of the motorized vehicle 100 may be corrugated. The corrugations may allow the surface to comply with the paved surface 200 by bending at the grooves 801. Actuating elements 802 may be attached to the ridges 803 of the corrugated surface 800. This may allow the rigidity of the press plate 109 to be controlled based on the pressure applied by the actuating elements 802. The actuating elements 802 may be placed on every ridge 803 of the corrugated surface 800 as shown in FIG. 8 or at a desired interval such as every other ridge 803 (not shown). The working surface 110 of the press plate 109 may comprise a nonstick and/or scratch resistant coating 804 selected from the group consisting of Fluoropolymers, Teflon®, diamond, carbide, carbon coatings, cubic boron nitride, and combinations thereof. The life span of the working surface 110 may be increased by reducing the amount of scratches and preventing aggregate 606 and rejuvenation fluids from sticking to the press plate 109.

Figure 9:
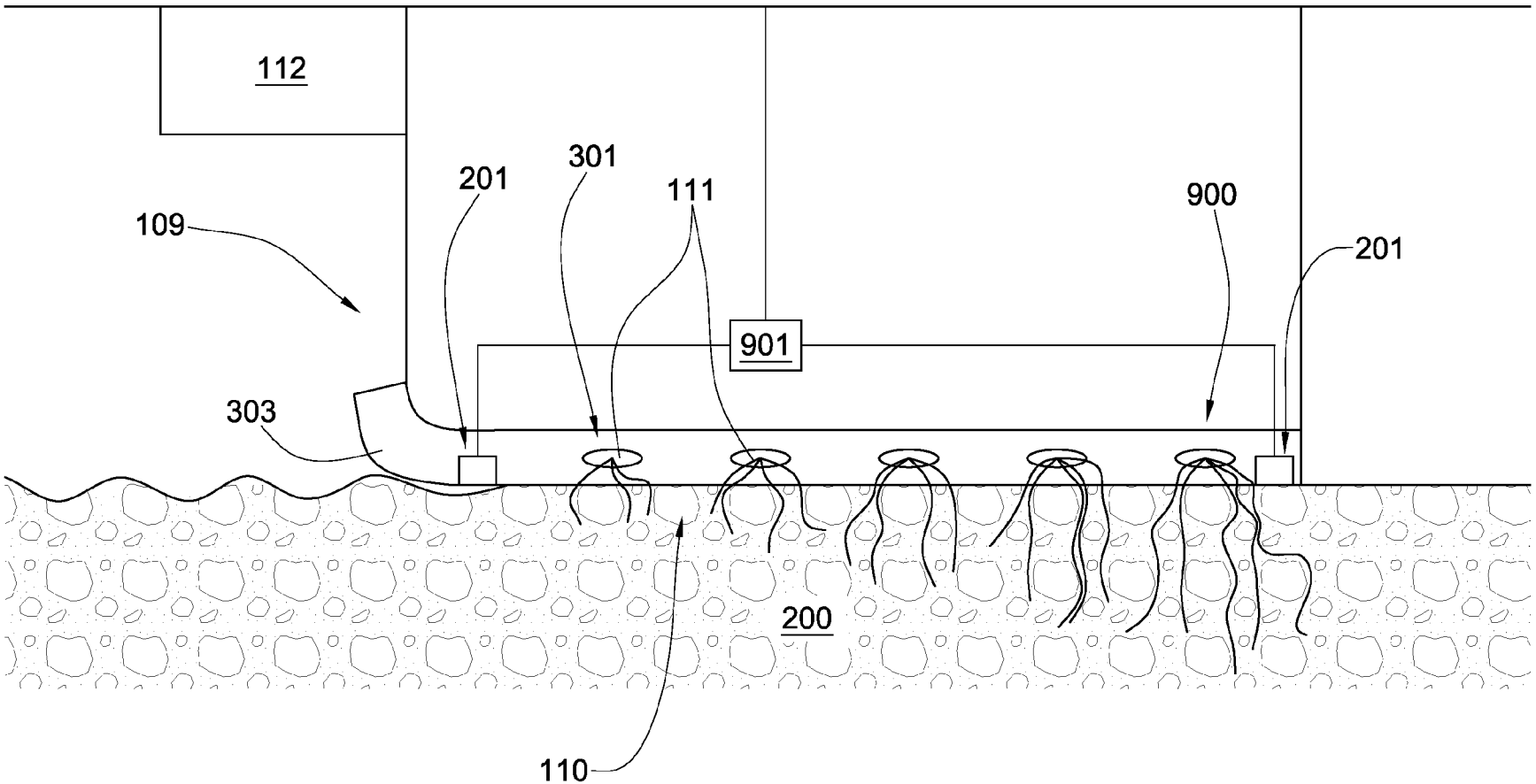
FIG. 9 is a cross sectional diagram of an embodiment of a press plate.

FIG. 9 is a cross sectional diagram of an embodiment of the press plate 109. In the current embodiment the press plate 109 is adapted to apply enough pressure to the paved surface 200 to cause the surface 200 to comply with the working surface 110 of the press plate 109. The front edge 303 of the press plate 109 may be rounded and/or angled up to help the paved surface 200 comply with the working surface 110. In the present embodiment the fluid nozzles 111 may be set to inject at varying pressures and temperatures. The first row 301 of nozzles 111 running perpendicular to the length of the vehicle may be set to have the lowest pressure. The pressures with which the rejuvenation material is injected may progressively increase from the first row 301 to the last row 900. In other embodiments the pressure may be adjusted from high pressure to low pressure starting at the first row 301 and ending on the last row 900. The pressures and temperatures may be adjusted depending on the paved surface 200 conditions and the desired results.

The press plate 109 may also comprise one or more sensors 201 selected from the group consisting of temperature sensors, pressure sensors, position sensors, density sensors, compressive strength sensor, porosity sensor, pH sensor, electric resistively sensor, inclination sensor, nuclear sensor, acoustic sensor, velocity sensor, moisture sensor, capacitance sensor, and combinations thereof. The sensors 201 may be used as part of a closed loop system used to maintain a constant pressure underneath the press plate 109. A pressure sensor 109 may measure the pressure of the paved surface 200 as the rejuvenation fluid is being injected and communicate the measured values to a controller 901. If the pressure of the paved surface 200 goes higher or lower than a desired pressure, the controller 901 may send a signal to adjust the pressure with which the rejuvenation fluid is being injected. If the pressure is too low, the controller 901 may adjust the nozzle 111, and or fluid reservoir 112 to inject the fluid at a higher pressure and/or temperature.

Figure 10:
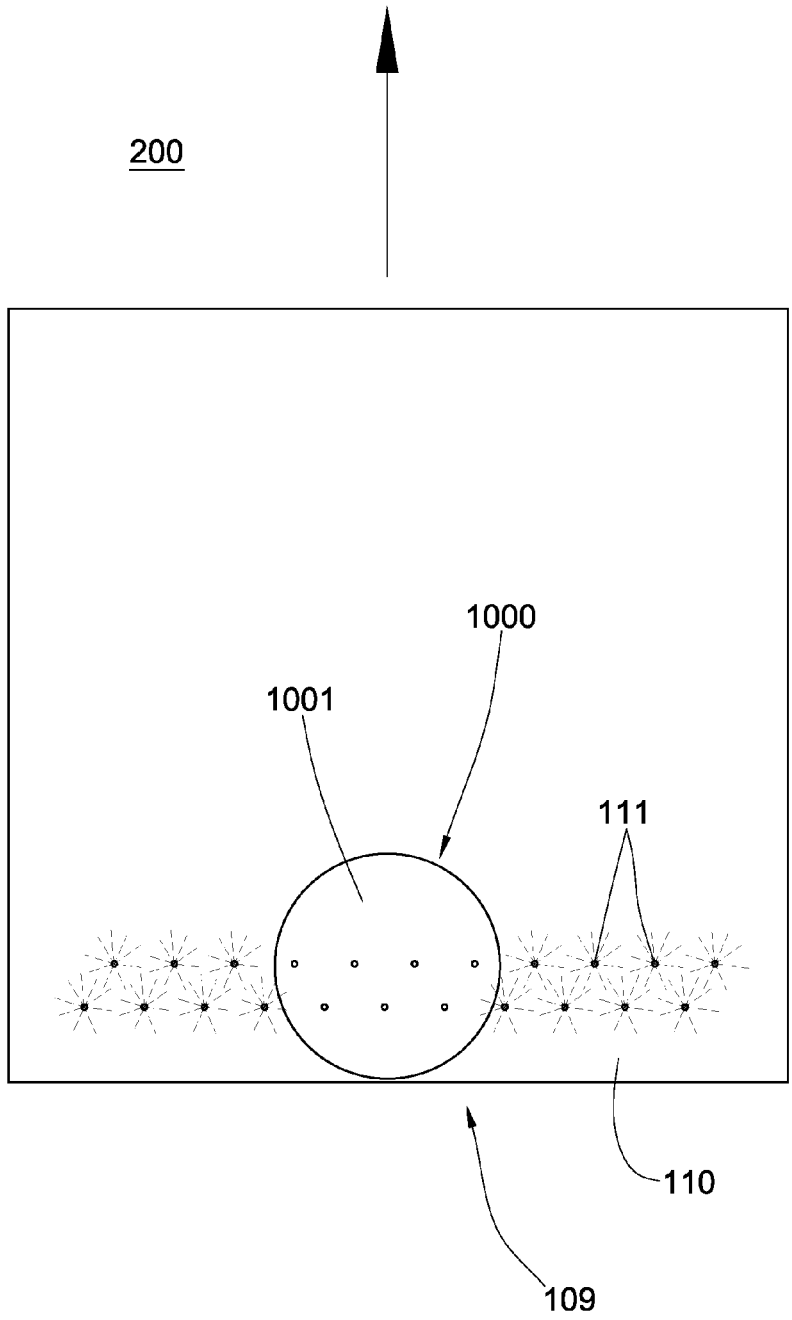
FIG. 10 is a diagram of an embodiment of a working surface of a press plate.
Figure 11:
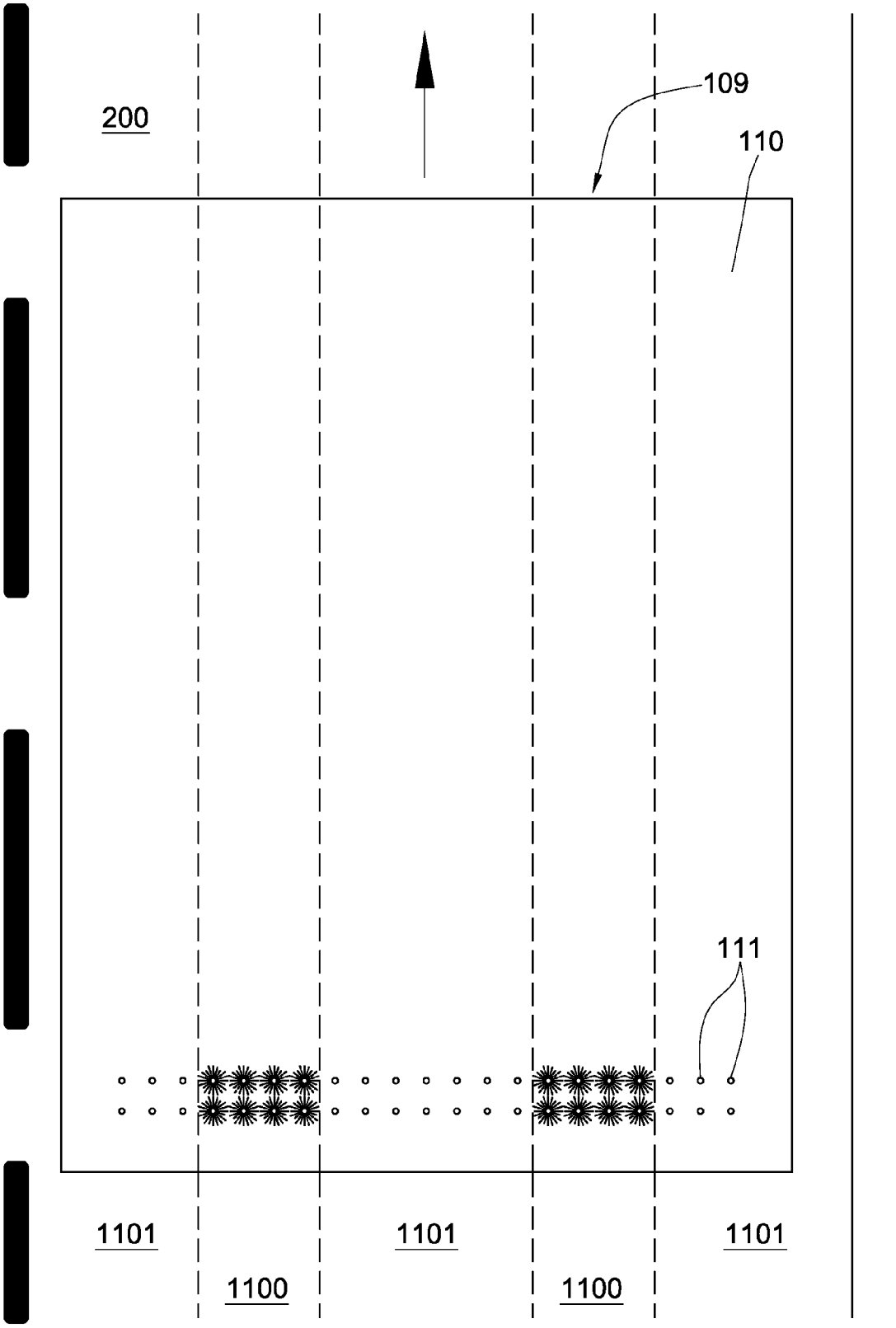
FIG. 11 is a diagram an alternate embodiment of a working surface of a press plate.

FIG. 10 is a diagram of an embodiment of the working surface 110 of the press plate 109. The nozzles 111 on the press plate 109 may be independently controllable allowing only a portion of the nozzles 111 to be on at any given time. If a portion of the paved surface 200 may not be reconditioned due to an obstacle 1000 such as a railroad crossing (not shown) or a manhole 1001, the fluid nozzles may be turned off for a portion of time until the obstacle 1000 is passed. FIG. 11 diagrams an alternate embodiment of the working surface 110 of the press plate 109. The injection system may be controlled digitally such that nozzle 111 may be controlled individually. Preferably, each nozzle 111 pulses the rejuvenation material into the paved surface 200 when commanded by a closed loop system. Pulsing may allow greater control of the flow of rejuvenation material since?. In other embodiments, the nozzles 111 may continuously inject fluid into the paved surface 200. Preferably, there are two rows of nozzles 111, which are offset from each other.

As in FIG. 10, FIG. 11 diagrams the press plate 109 with only a portion of the nozzles 111 injecting fluid. This spray pattern may be beneficial when only a portion of the paved surface 200 may be in need of reconditioning. In the current embodiment the nozzles 111 may be turned on around the portion 1100 of the paved surface 200 that has received a greater amount of wear and tear. Such portions 1100 of the paved surface 200 may be areas where the tires of an automobile are most commonly in contact with the pavement 200. In such embodiments the nozzles 111 may controllably inject rejuvenation fluids to the portions 1100 of the paved surface 200 that need reconditioning which may be determined through a closed loop system. In one embodiment, nozzles 111 may inject a greater volume of rejuvenation material into the portions 1100 of pavement 200 more worn and decrease the amount of rejuvenation material injected into portions 1101 on the paved surface that are less worn. Many variations of injection patterns may be used and should not be limited to those shown but other patterns obvious to one skilled in the art.

Figure 12:
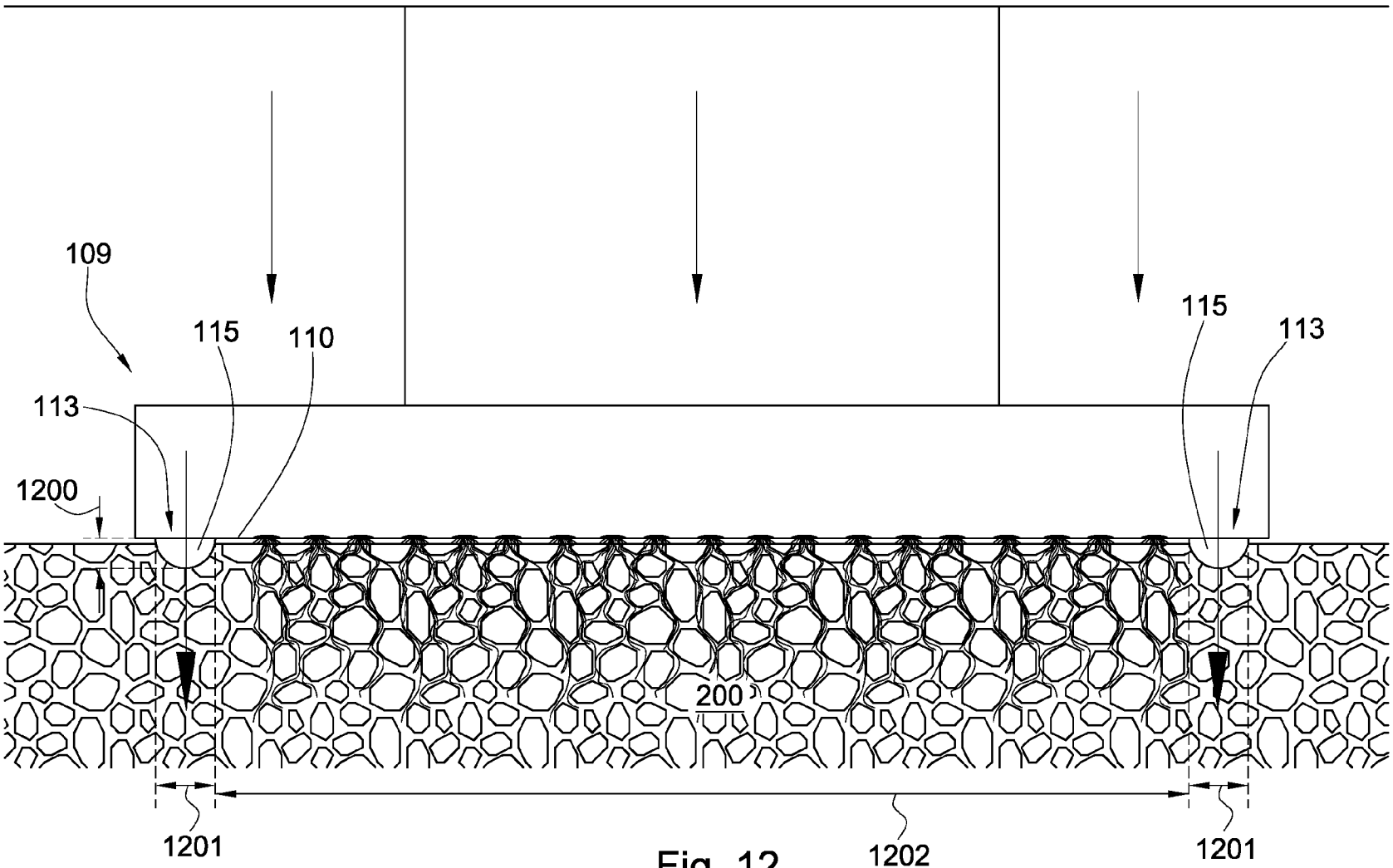
FIG. 12 is a cross sectional diagram of an embodiment of a press plate comprising multiple sealing elements.

FIG. 12 is a cross sectional diagram of an embodiment of a press plate 109 comprising multiple sealing elements 113. In the present embodiment the sealing elements 113 are carbide strips 115 placed on the two sides 114 of the press plate 109 that run parallel with the length of the motorized vehicle 100. Because the carbide strips 115 may extend beyond the working surface 110 they may apply a greater amount of pressure upon the regions 1201 of pavement 200 in contact with the carbide strips 115. Or in other words, the volume 1201 beneath the sealing elements 113 will be more compressed then the volume 1202 beneath the press plate 109. Because the volume 1201 underneath the sealing elements 113 has a higher pressure, the volume 1202 under the press plate 109 will be the path of least resistance for the rejuvenation material. This may contain the rejuvenation material underneath the press plate 109. The strips 115 may extend beyond the working surface 110 by a distance 1200 sufficient to generate enough pressure in the volume 1201 of pavement 200 below the strips 115 to keep the majority of the injected rejuvenation fluid in the volume of pavement 1202 below the press plate 109. In one embodiment the strips 115 extending distance 1200 may be adjustable so that the strips 115 extend further for higher injection pressures and less for lower injection pressures. In other embodiments the strips 115 may be removable inserts (not shown) that may be easily replaced or adjusted to correspond with different conditions.

Figure 13:
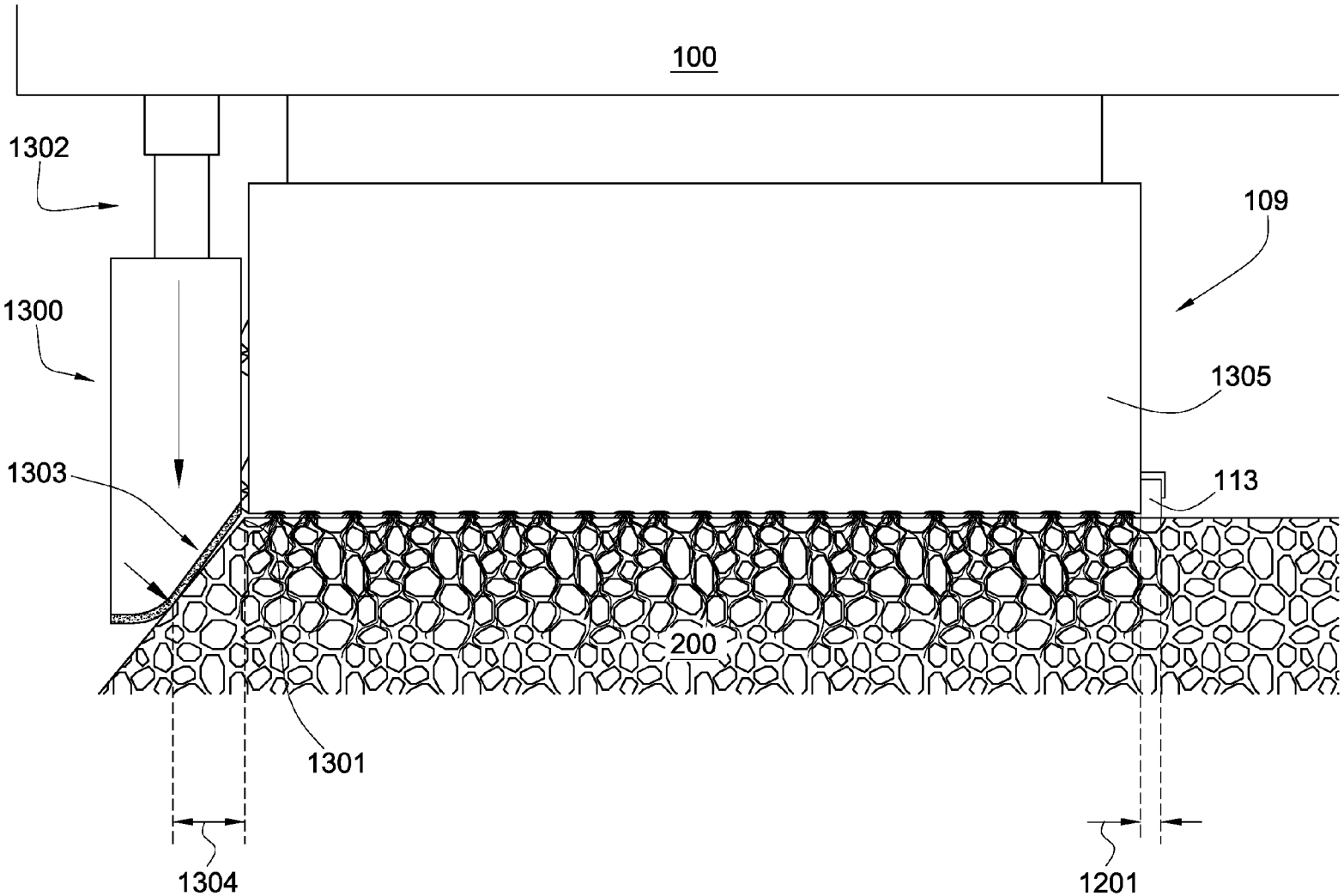
FIG. 13 is a cross sectional diagram of an embodiment of a press plate comprising an edge packer.

FIG. 13 is a cross sectional diagram of an embodiment of a press plate 109 comprising an edge packer 1300. In the current embodiment the pavement reconditioning vehicle 100 may be used to recondition a paved surface 200 with at least one pavement edge 1301. The pavement edge 1301 may be rounded, flat, beveled, or have any other edge known in the art. In the current embodiment the edge 1301 of the pavement 200 is beveled down at an angle. The edge packer 1300 may be attached to the motorized vehicle 100 through an actuator 1302. The bottom face 1303 of the edge packer 1300 may be beveled or curved to correspond with the edge 1301 of the paved surface 200. The edge packer 1300 may be adapted to apply a sufficient pressure to the edge of the paved surface 200 to prevent the edge 1301 from expanding out due to the high pressure from the injection of the rejuvenation material. The edge packer 1300 may also help maintain a constant pressure within the paved surface 200 by creating a dense region 1304 of pavement with a higher resistively to the pressurized fluid. The opposing side 1305 of the press plate 109 may also comprise a sealing element 113. Variations from the present embodiment may include using one or more rollers (not shown) adapted to roll along the edge 1301 of the paved surface 200 next to the press plate 109.

Figure 14:
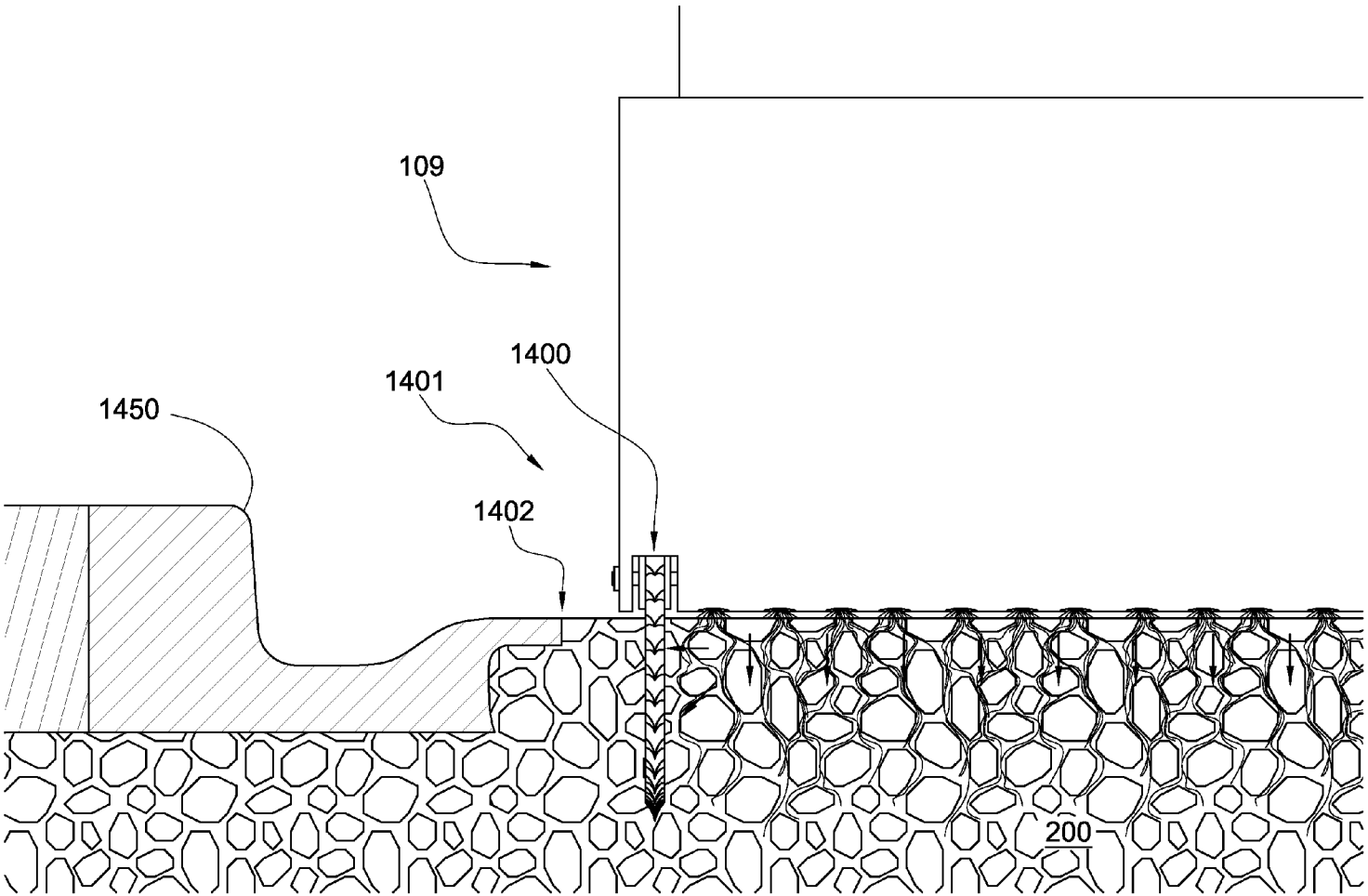
FIG. 14 is a cross sectional diagram of an embodiment of a press plate comprising an edge saw.

FIG. 14 is a cross sectional diagram of an embodiment of a press plate 109 comprising an edge saw 1400. The saw 1400 may perform a similar function to the edge packer 1300 described in FIG. 13. The edge saw 1400 may be used at transitions in the paved surface 200 such as a change of material or structure. In the current embodiment the sides 1401 of the paved surface 200 may comprise a transition 1401 such as a cement curb, sidewalk or gutter. To prevent pressure from escaping out the side of the press plate 109 near the transition 1402, the edge saw 1400 may cut along next to the press plate 109. The saw 1400 may help prevent the pressure from the injected fluid from escaping from underneath the press plate 109 by creating a barrier to the pressure. If the pressure is allowed to escape from under the press plate 109 the volume of material underneath the transition 1402 may become pressurized and expand. This form of expansion may crack, misalign, and dislodge the cement curb, sidewalk and or gutter.

Figure 15:
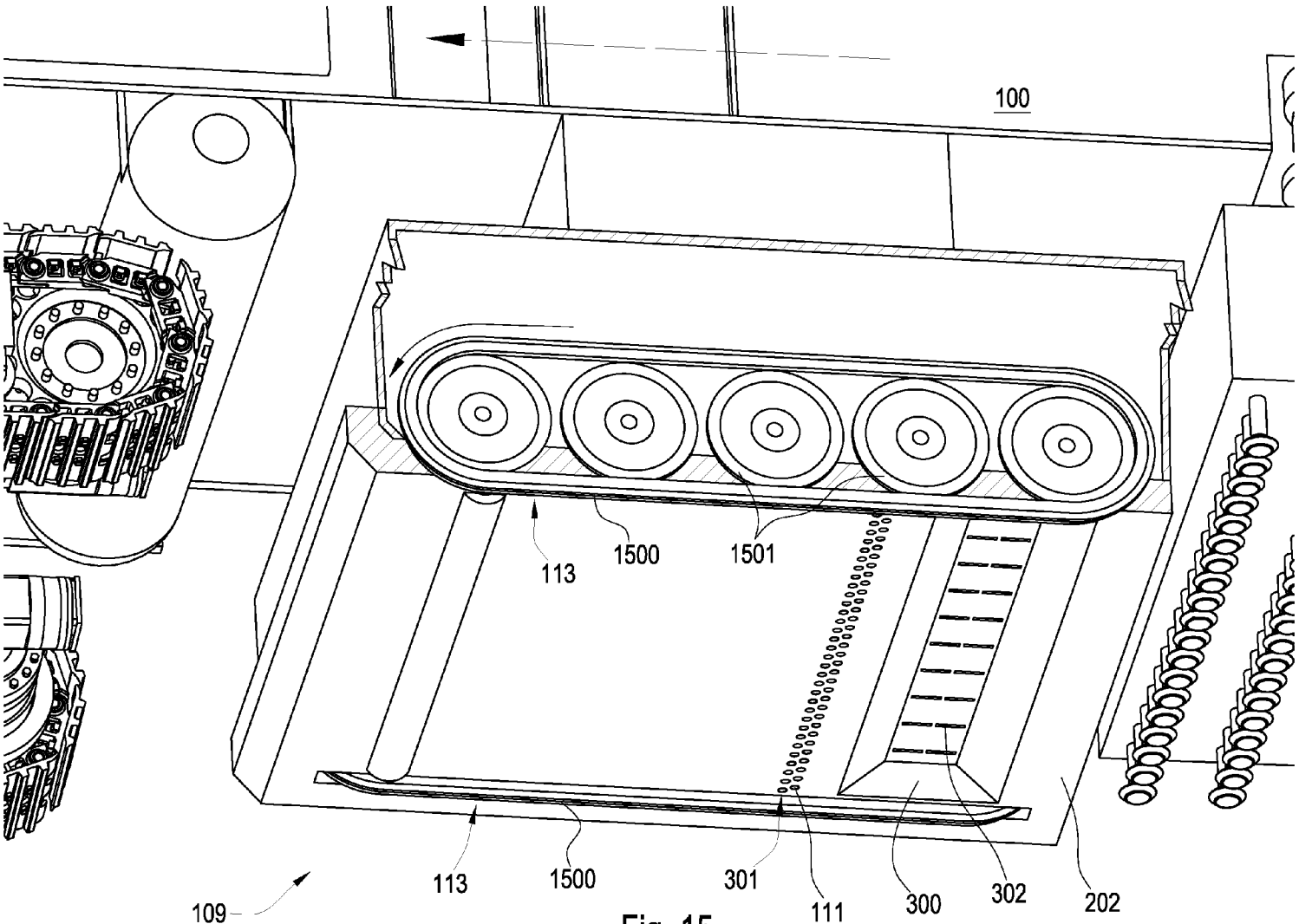
FIG. 15 is a perspective diagram of an alternate embodiment of a portion of a motorized vehicle adapted to recondition a paved surface.

FIG. 15 is a perspective diagram of an alternate embodiment of a portion of a motorized vehicle 100 adapted to recondition a paved surface 200. In the current embodiment the press plate 109 may comprise two or more staggered rows 301 of nozzles 111. The press plate 109 may further comprise an expansion chamber 300 with release vents 302. The sealing elements 113 on the press plate 109 may comprise one or more rings 1500 secured around one or more pulleys 1501. The pulleys 1501 may spin freely or the spinning may be controlled by a motor (not shown). As the motorized vehicle 100 moves along the paved surface 200 a section of the ring 1500 may come into contact with the paved surface 200. The section of ring 1500 may maintain contact with the same area of pavement 200 until the back end 202 of the press plate 109 is reached. At the back end 202 of the press plate 109 the ring 1500 may begin to come off of the paved surface 200 and follow the pulley 1501. The sealing element 113 of the present embodiment may last longer because it is applied and lifted from the paved surface 200 instead of being dragged along the paved surface 200.

Figure 16:
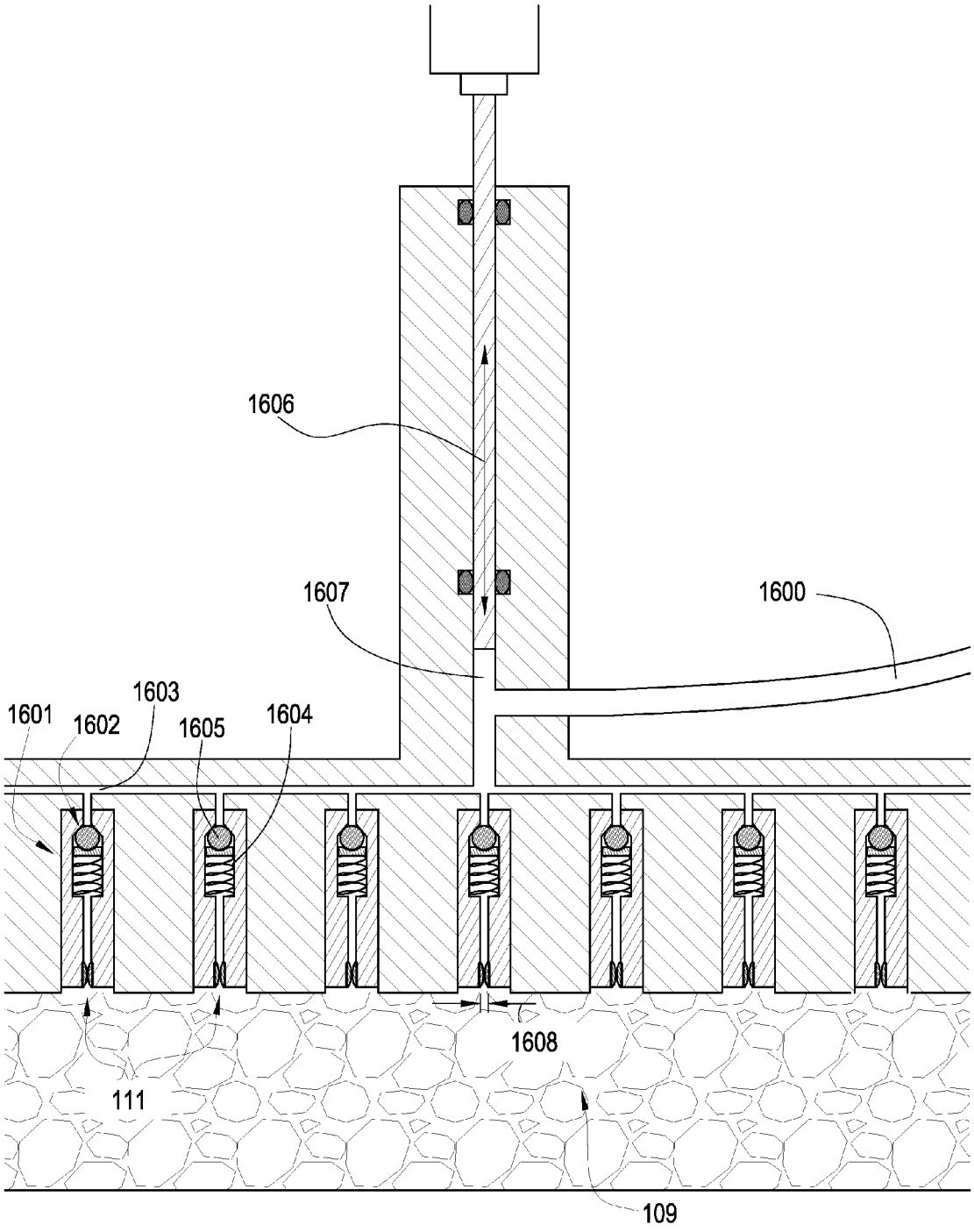
FIG. 16 is a cross sectional diagram of an embodiment of injection nozzles and a press plate.

FIG. 16 is a cross sectional diagram of an embodiment of the injection nozzles 111 and the press plate 109. In the present embodiment multiple nozzles 111 are disposed within the press plate and in communication with a supply line 1600. A check valve assembly 1601 may be disposed between the supply line and the nozzle. The check valve assembly 1601 may comprise a chamber 1602 intermediate an inlet 1603 and an outlet. The chamber 1602 may comprise a spring 1604 which is adapted to push a ball 1605 against the inlet 1603 to seal it from allowing fluid through. The ball 1605 may be forced down into the chamber 1602 when the fluid from the supply line 1600 reaches a sufficient pressure to compress the spring 1604. With the spring 1604 slightly compressed the fluid coming from the supply line 1600 may flow around the ball 1605 through the chamber 1602 and out the nozzle 111. The supply line 1600 may be connected to the fluid reservoir (not shown) and may be able to handle a high pressure and high temperature. A piston 1606 may be placed along the pathway 1607 to the inlet 1603 to increase the pressure to a high enough pressure to open the check valve assembly 1601. The piston 1606 may be placed along the supply line 1600 such that the supply line 1600 to the reservoir (not shown) is closed as the piston 1606 is actuated. This may allow a fixed volume of fluid to be pressurized as the piston 1606 is depressed. In the current embodiment it may be desirable to pressurize the fluid to a pressure between 3000 psi and 65000 psi. The nozzles 111 may comprise and inner diameter 1608 between 1 micron and 1000 microns. This may help control the amount of fluid injected into the paved surface 200 and maintain the desired pressure. The distance between adjacent nozzles may be anywhere from 0.1 to 1 inch Preferably in embodiments, where the rows of nozzles are offset, a nozzle may be 0.5 inches away from the closest adjacent nozzle and 0.75 inches away from the closest nozzle in the adjacent row.

Figure 17:
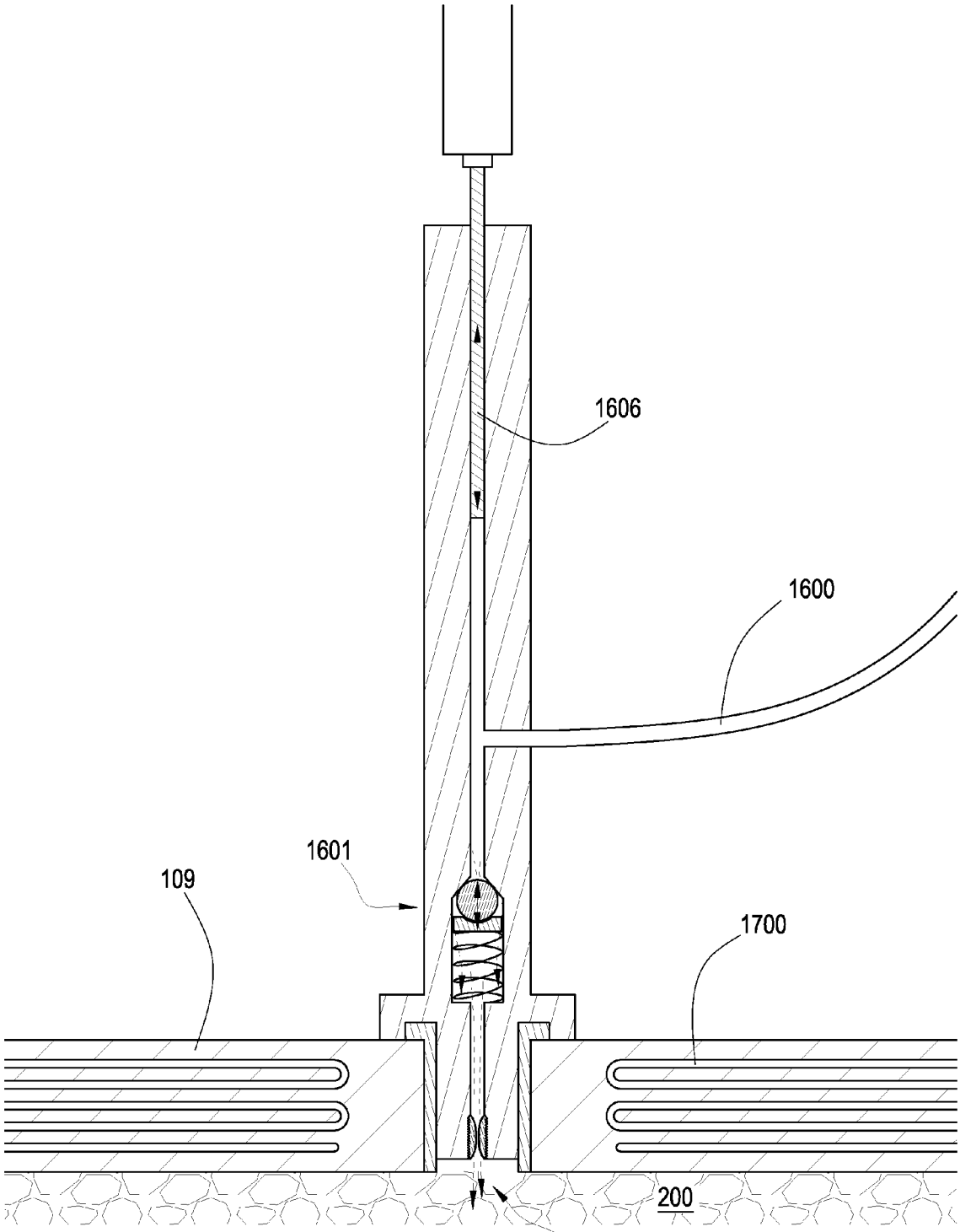
FIG. 17 is a cross sectional diagram of an embodiment of a press plate and a fluid nozzle.

FIG. 17 is a cross sectional diagram of an embodiment of the press plate 109 and fluid nozzle 111. The present embodiment is a variation of the embodiment of FIG. 16 with each of the nozzles 111 comprising an independent supply line 1600. A piston 1606 and a check valve 1601 may be disposed within the supply line 1600 The press plate 109 may also comprise a heating element 1700 to maintain the paved surface 200 at a constant temperature. The heating element 1700 may be an electric heater, gas powered heater, or any other form of pavement/asphalt heater known in the art. The press plate 109 may heat up as the motorized vehicle 100 traverses the paved surface 200 injecting rejuvenation material. After the press plate 109 heats up, less energy may be required by the heating elements 1700 to bring the paved surface to a desired temperature.

Figure 18:
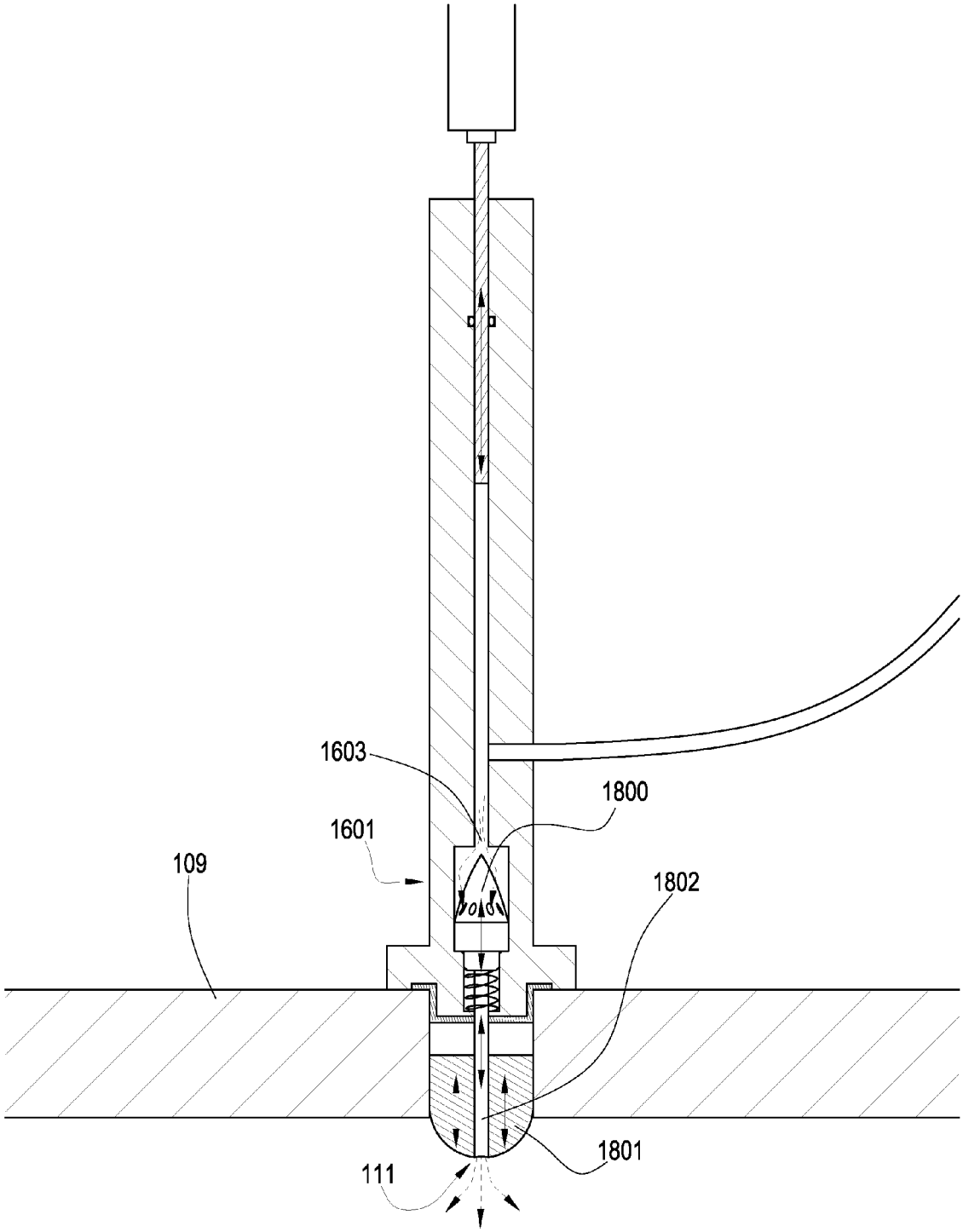
FIG. 18 is a cross sectional diagram of an alternate embodiment of a press plate and a fluid nozzle.

FIG. 18 is a cross sectional diagram of another embodiment of the press plate 109 and fluid nozzle 111. A cone 1800 is provided that is capable stopping the inlet 1603 from allowing the passage of fluid to the nozzle 111 in its closed position The fluid nozzle 111 may be formed from a ball 1801. Preferably the ball 1801 is made of a hard durable material such a tungsten carbide, hardened steal, titanium, cobalt and other hard materials known in the art. Preferably the ball has a hardness of at least 58 HRc. A hole 1802 may then be made using electronic discharge machining (EDM) through the ball 180. The hole may comprise a diameter of 1 micron to 1000 microns. Larger diameter holes 1802 may also be used if a larger volume of fluid is desired. The hole 1802 may then act as a nozzle 111 for the pressurized fluid when the pressure is high enough to open the check valve assembly 1601. The ball 1801 may be connected to the plate 109 by threads or by brazing.

In some embodiments of the present invention, each time the pressure reaches the threshold to release the fluid, an automatic mechanism may push the entire nozzle towards the paved surface such that the nozzle slightly indents the paved surface before the fluid is released. In this manner the fluid may not have enough time to evaporate before it hits the paved surface and all of the fluid may be injected into the surface.

Figure 19:
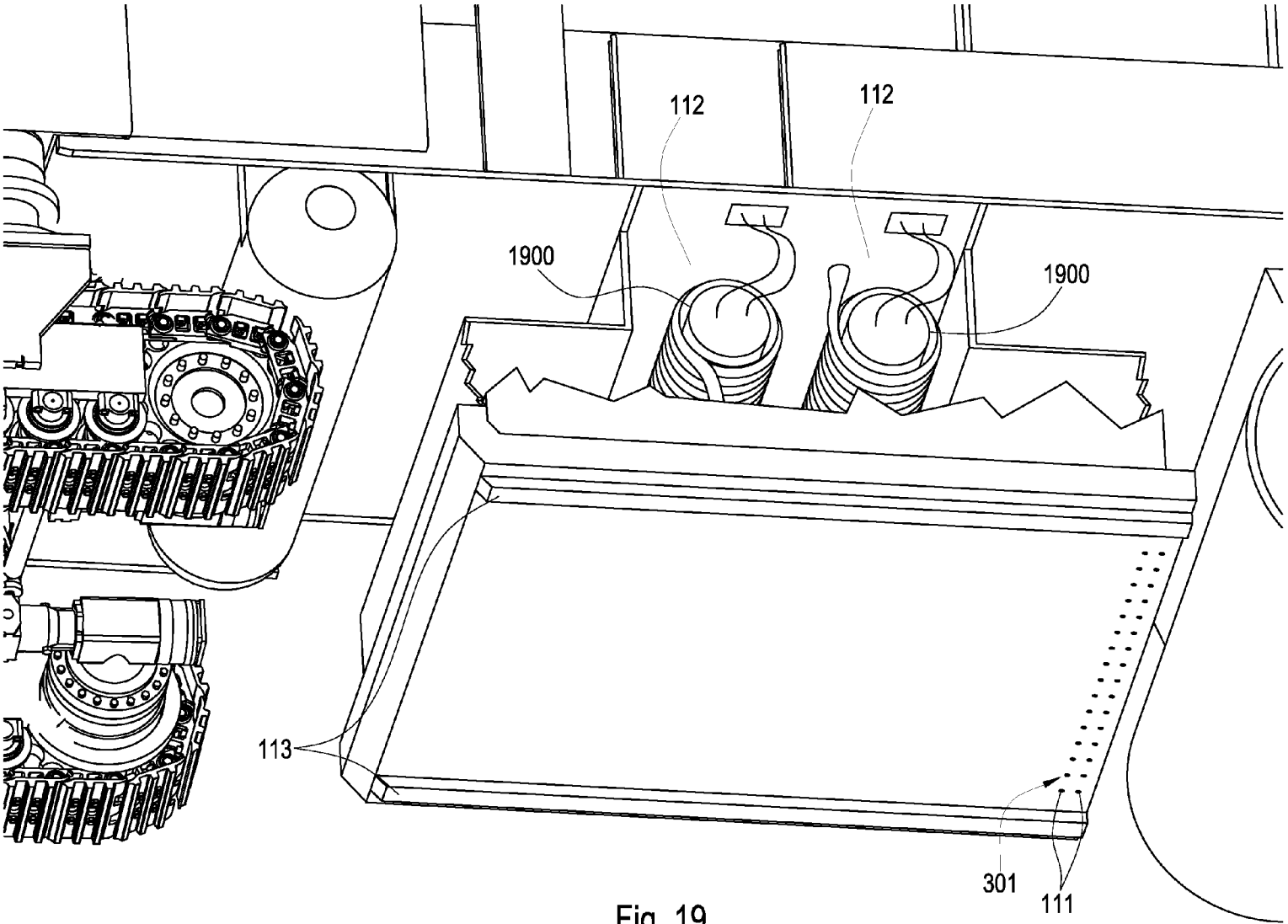
FIG. 19 is a diagram of an alternate embodiment of a press plate and a fluid reservoir.

FIG. 19 is a diagram of an alternate embodiment of the press plate 109 and the fluid reservoir 112. The press plate 109 comprises multiple rows 301 of nozzles 111 and sealing elements 113 on each side. The fluid reservoir 112 may be made up of one or more coils of electrically heated hose 1900. The hose 1900 may be designed to withstand high pressures and high temperatures. In one embodiment the hose 1900 may comprise heating elements (not shown) within the outer sheath. The hose 1900 may be able to heat the fluid to a temperature above 500° F. In one embodiment the hose 1900 may be able to heat the fluid to a temperature between 250° F. and 700° F., preferably to 500° F. One such hose 1900 may include the electrically heated hose made by Applicator Systems Inc. whose size 3 hose (0.125" inner diameter) is capable of operating at 3500 psi at 400° F.

Figure 20:
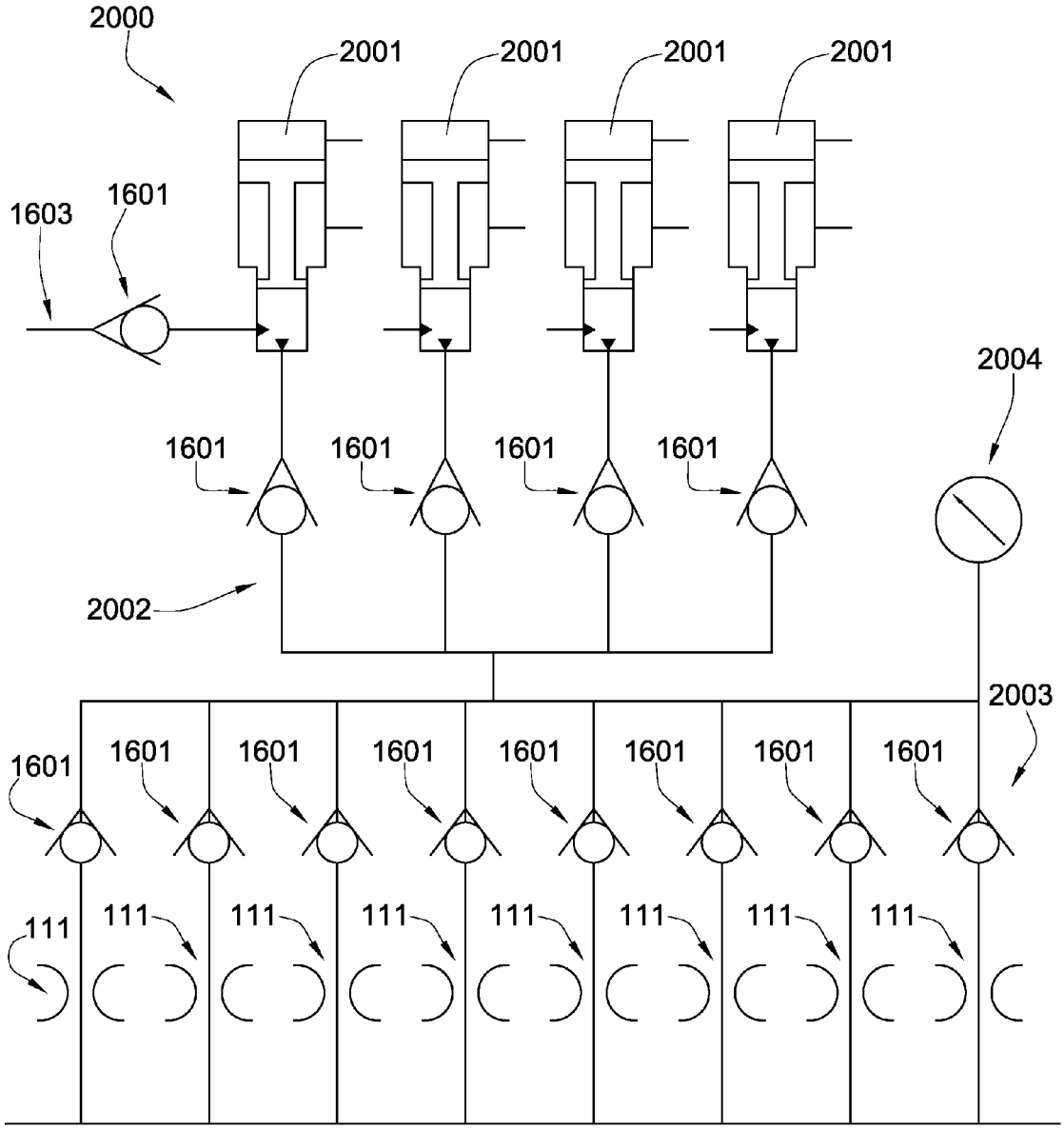
FIG. 20 is a schematic of a rejuvenation fluid injection system.

FIG. 20 is a schematic of a rejuvenation fluid injection system 2000. The system 2000 includes check valves 1601 intermediate fluid inlets 1603 and intensifiers 2001. In one embodiment the fluid must exceed 300 psi at 450° F. to pass through the check valves 1601 and into the intensifiers 2001. Once in the intensifiers 2001, the fluid pressure may be increased up to a desired pressure. The fluid may then pass through a series of check valves 1601 and through nozzles 111 to the pavement. The first set 2002 of check valves 1601 may open at a low pressure such as 5 psi and may be used to ensure that fluid is not forced back into the intensifier 2001 by only allowing fluid flow in one direction. The second set 2003 of check valves 1601 may open around a pressure of 750 psi. Because the nozzles 111 may have such a small size opening for the fluid passage, the nozzles 111 may in part act as a limiter and help build pressure within the system. The pressure may increase between the intensifier and the nozzles until it reaches a pressure of up to 10000 psi. A pressure indicator 2004 may be in communication with the system 2000 to inform an operator of the pressure within the system 2000.

Figure 21:
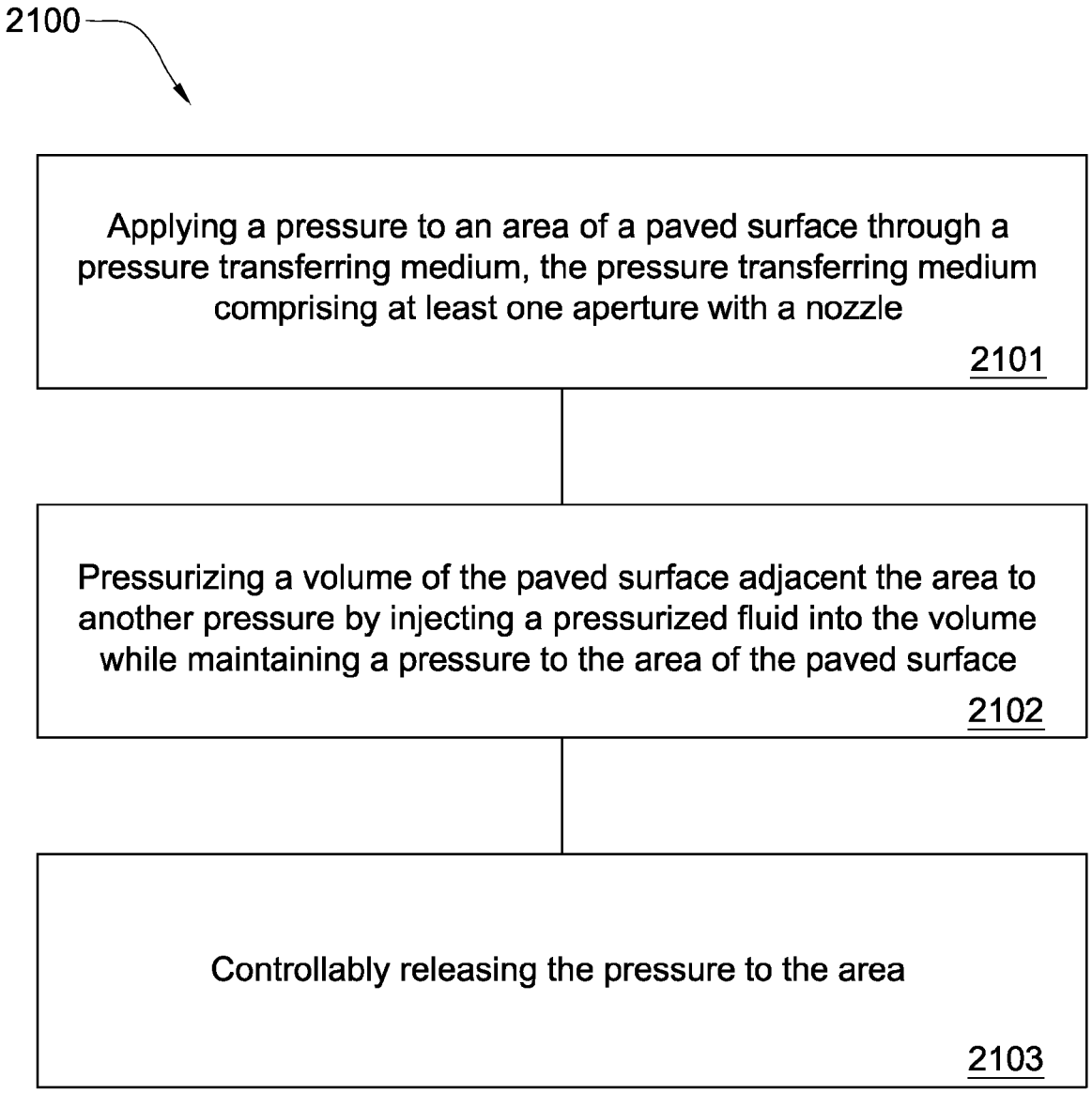
FIG. 21 is a block diagram of a method for reconditioning a paved surface.

FIG. 21 is a block diagram of a method 2100 for reconditioning a paved surface. The method 2000 may include the steps of applying 2101 a pressure to an area of a paved surface through a pressure transferring medium, the pressure transferring medium comprising at least one aperture with a nozzle; pressurizing 2102 a volume of the paved surface adjacent the area to another pressure by injecting a pressurized fluid into the volume while maintaining a pressure to the area of the paved surface; and controllably 2103 releasing the pressure to the area.

Whereas the present invention has been described in particular relation to the drawings attached hereto, it should be understood that other and further modifications apart from those shown or suggested herein, may be made within the scope and spirit of the present invention.

What is claimed is:

1. A paved surface reconditioning system comprising:

a vehicle adapted to traverse a paved surface comprising a press plate;

the press plate comprising a working surface with a plurality of nozzle disposed therein;

at least one of the nozzles comprising an inner diameter less than 1 mm;

a fluid passage connecting the nozzles to a reservoir;

the reservoir and fluid passage comprising a volume; and a pressurizing mechanism in communication with the volume and being adapted to pressurize at least a portion of the volume.

2. The system of claim 1, wherein the motorized vehicle comprises an actuator intermediate the press plate and the motorized vehicle.

3. The system of claim 1, wherein the vehicle comprises a compaction element selected from the group consisting of rollers, tampers, plates, vibrators and combinations thereof.

4. The system of claim 1, wherein the working surface comprises a coating selected from the group consisting of Fluoropolymers, Teflon®, diamond, carbide, carbon coatings, cubic boron nitride, and combinations thereof.

5. The system of claim 1, wherein the press plate comprises a heating element.

6. The system of claim 1, wherein the press plate comprises a sensor selected from the group consisting of temperature sensors, pressure sensors, position sensors, density sensors, compressive strength sensor, porosity sensor, pH sensor, electric resistively sensor, inclination sensor, nuclear sensor, acoustic sensor, velocity sensor, moisture sensor, capacitance sensor, and combinations thereof.

7. The system of claim 1, wherein the press plate comprises a sealing element on at least one side adapted to engage the paved surface.

8. The system of claim 1, wherein the press plate is part of a closed loop system.

9. The system of claim 1, wherein the press plate is adapted to comply with the paved surface.

10. The system of claim 1, wherein the working surface comprises a portion adapted to contact the paved surface and an expansion cavity formed in the portion.

11. The system of claim 10, wherein the expansion cavity comprises an aggregate dispenser.

12. The system of claim 10, wherein the expansion cavity comprises a vent.

13. The system of claim 12, wherein the vent comprises a passage to the reservoir.

14. The system of claim 13, wherein the passage to the reservoir comprises a condenser.

* * * * *